US010293615B2

(12) United States Patent
Kawagoe et al.

(10) Patent No.: US 10,293,615 B2
(45) Date of Patent: May 21, 2019

(54) LIQUID SUPPLY APPARATUS

(71) Applicant: Brother Kogyo Kabushiki Kaisha, Nagoya-shi, Aichi-ken (JP)

(72) Inventors: Masako Kawagoe, Nagoya (JP); Taichi Shirono, Nagoya (JP); Yoshinori Osakabe, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/993,035

(22) Filed: May 30, 2018

(65) Prior Publication Data

US 2018/0345675 A1 Dec. 6, 2018

(30) Foreign Application Priority Data

May 31, 2017 (JP) ..... 2017-108475

(51) Int. Cl.
*B41J 2/175* (2006.01)

(52) U.S. Cl.
CPC ..... *B41J 2/1754* (2013.01); *B41J 2/17509* (2013.01); *B41J 2/17553* (2013.01); *B41J 2/17566* (2013.01); *B41J 2002/17573* (2013.01)

(58) Field of Classification Search
None
See application file for complete search history.

(56) References Cited

U.S. PATENT DOCUMENTS

2012/0056938 A1* 3/2012 Ishizawa ..... B41J 2/175 347/44
2014/0043408 A1* 2/2014 Kudo ..... B41J 2/175 347/86
2018/0093512 A1* 4/2018 Yamamoto ..... B41J 29/13

FOREIGN PATENT DOCUMENTS

JP 2012-051306 A 3/2012

* cited by examiner

*Primary Examiner* — Henok D Legesse
(74) *Attorney, Agent, or Firm* — Banner & Witcoff, Ltd.

(57) ABSTRACT

A liquid supply apparatus includes: a tank including a liquid storage chamber, a first wall configured such that liquid stored in the liquid storage chamber visually recognizable from outside, and a second wall having a supply opening; a cover configured to cover at least the first wall and including a third wall having a light transmitting portion via which a particular portion of the first wall is visually recognizable from outside; a film bonded to the tank and partly protruding toward the cover from a portion of the first wall different from the particular portion; and a positioner configured to position the tank with respect to the cover. The film extends in a direction containing a component in an up and down direction. A length of the portion of the film which protrudes from the first wall is greater than the particular length.

12 Claims, 15 Drawing Sheets

LIQUID SUPPLY APPARATUS

CROSS REFERENCE TO RELATED APPLICATION

The present application claims priority from Japanese Patent Application No. 2017-108475, which was filed on May 31, 2017, the disclosure of which is herein incorporated by reference in its entirety.

BACKGROUND

The following disclosure relates to a liquid supply apparatus including a tank refillable with liquid through a supply opening.

There is known a printer including: a tank refillable with ink; and a recording head configured to receive the ink from the tank and record an image on a sheet by ejecting the ink through nozzles. When the ink stored in the tank is consumed, a user can refill the tank through the supply opening of the tank with the ink stored in a bottle.

The tank of such a printer normally includes a visual-recognition wall. The visual-recognition wall allows a user to check a remaining amount of the ink stored in the tank, from outside of the tank. The visual-recognition wall is formed of a material having such light transparency that the inside of the tank is visually recognizable from the outside of the tank.

SUMMARY

There is a possibility of leakage of the ink to the outside of the tank when the ink stored in the bottle is resupplied into the tank through the supply opening. The supply opening of the tank is normally formed at a position accessible from the outside, i.e., a position exposed to the outside of the printer. That is, the supply opening of the tank is formed near the visual-recognition wall. This construction may lead to a problem in which the ink having leaked to the outside of the tank attaches to the visual-recognition wall.

Accordingly, an aspect of the disclosure relates to a technique for reducing adherence of liquid to a visual-recognition wall provided for a user to check a remaining amount of the liquid stored in a tank that is refillable with the liquid.

In one aspect of the disclosure, a liquid supply apparatus includes: a tank including (i) a liquid storage chamber, (ii) a first wall that extends in a widthwise direction directed along a horizontal direction and that is configured such that liquid stored in the liquid storage chamber visually recognizable from an outside of the tank, and (iii) a second wall provided above the first wall and having a supply opening through which the liquid is to be supplied to the liquid storage chamber; a cover including a third wall having a light transmitting portion, the cover being configured to cover at least the first wall of the tank in a state in which the third wall and the first wall are opposed to each other, and a particular portion of the first wall is visually recognizable from an outside of the cover via the light transmitting portion; a film bonded to the tank such that a portion of the film protrudes toward the cover from a portion of the first wall which is different from the particular portion; and a positioner configured to position the tank with respect to the cover in a state in which a distance, in a direction in which the film protrudes, between the cover and a portion of the film which is bonded to the tank is equal to a particular length, wherein the film extends in a direction containing a component in an up and down direction, and wherein a length of the portion of the film which protrudes from the first wall is greater than the particular length.

In another aspect of the disclosure, a liquid supply apparatus includes: a tank including (i) a liquid storage chamber, (ii) a first wall that extends in a widthwise direction directed along a horizontal direction and that is configured such that liquid stored in the liquid storage chamber visually recognizable from an outside of the tank, (iii) a second wall provided above the first wall and having a supply opening through which the liquid is to be supplied to the liquid storage chamber, and (iv) a side wall extending in a direction orthogonal to the widthwise direction; a cover including a third wall having a light transmitting portion, the cover being configured to cover at least the first wall of the tank in a state in which the third wall and the first wall are opposed to each other, and a liquid recognizable portion of the first wall is visually recognizable from an outside of the cover via the light transmitting portion; and a film bonded to the tank such that a portion of the film contacts the cover by protruding from an end of a portion of the side wall.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

DETAILED DESCRIPTION OF THE EMBODIMENTS

Figure 1A:
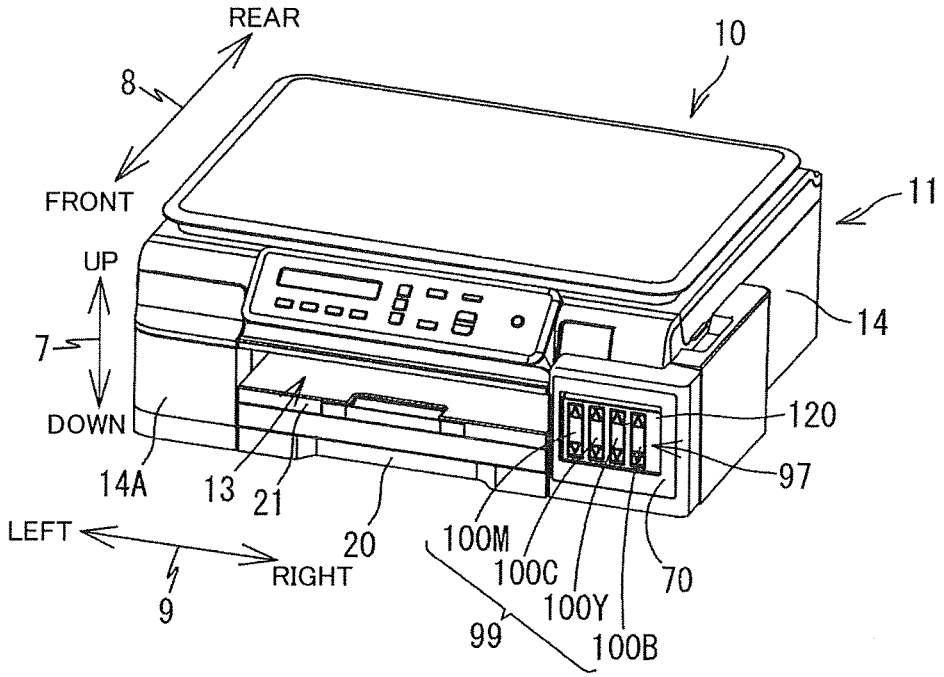
FIG. 1A is an external perspective view of a multi-function peripheral (MFP), illustrating a state in which a cover is located at a closing position.
Figure 1B:
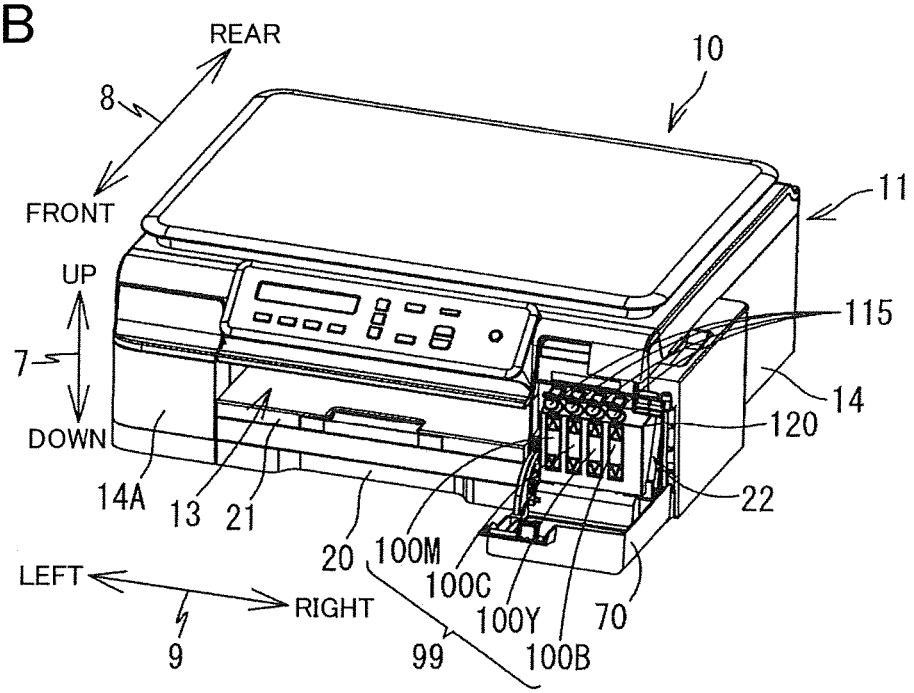
FIG. 1B is an external perspective view of the MFP, illustrating a state in which the cover is located at an exposing position.

Hereinafter, there will be described embodiments by reference to the drawings. It is to be understood that the following embodiments are described only by way of example, and the disclosure may be otherwise embodied with various modifications without departing from the scope and spirit of the disclosure. FIGS. 1A and 1B illustrate a multi-function peripheral (MFP) 10 in a use orientation in which the MFP 10 and ink tanks installed in the MFP 10 are horizontally and usably placed. The up and down direction 7 is defined with respect to this use orientation. The front and rear direction 8 is defined, assuming a surface of the MFP 10 which has an opening 13 is a front surface of the MFP 10. The right and left direction 9 (as one example of a widthwise direction) is defined in a state in which the MFP 10 is viewed from a front side thereof. The up and down direction 7, the front and rear direction 8, and the right and left direction 9 are orthogonal to each other. In the use orientation, the up and down direction 7 corresponds to the vertical direction, and each of the front and rear direction 8 and the right and left direction 9 corresponds to the horizontal direction in the present embodiment.

Overall Configuration of MFP 10

Figure 2:
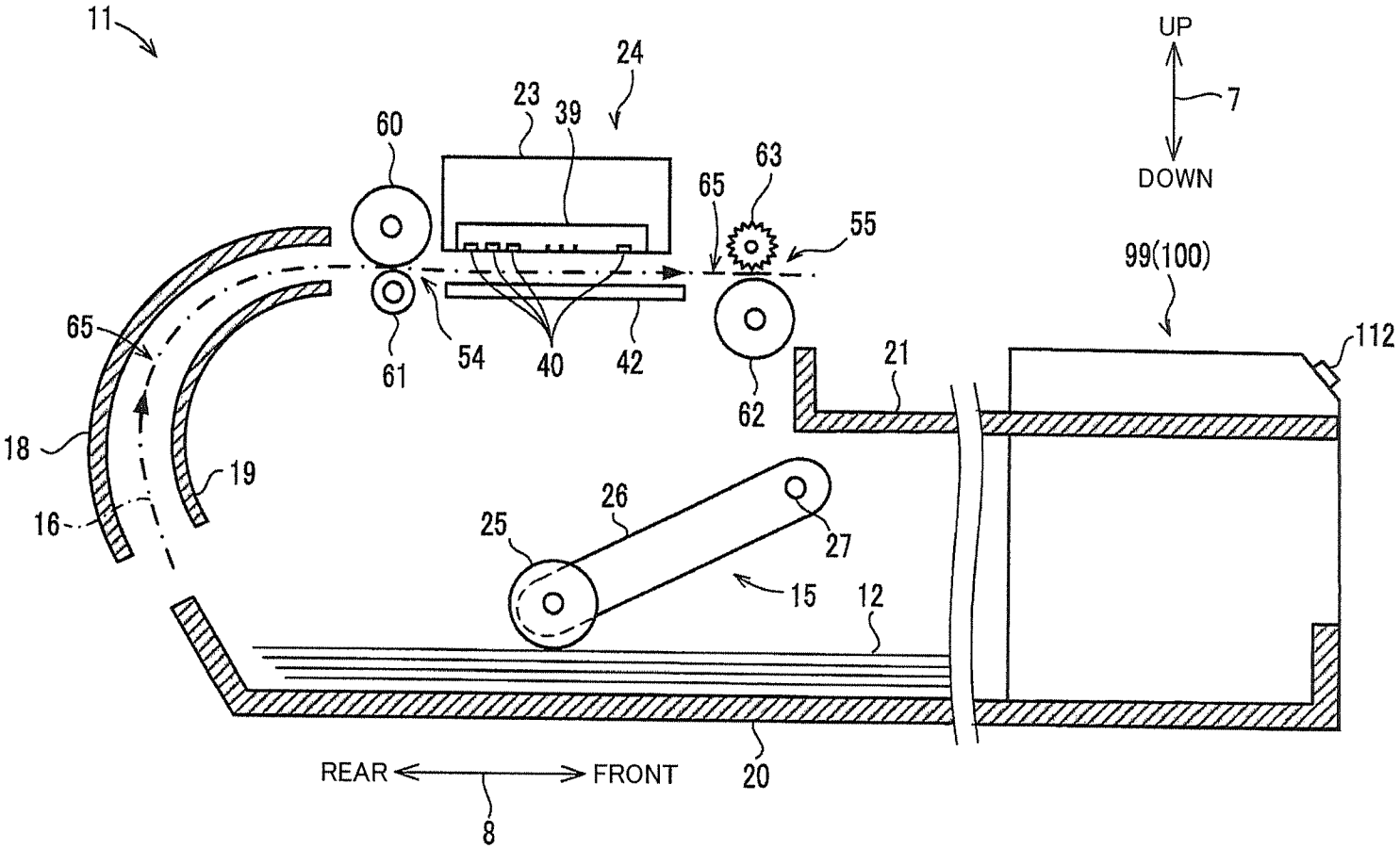
FIG. 2 is an elevational view in vertical cross section schematically illustrating an internal structure of a printing device.

As illustrated in FIGS. 1A and 1B, the MFP 10 (as one example of a liquid supply apparatus) has a substantially rectangular parallelepiped shape. The MFP 10 includes a printing device 11 at its lower portion. The printing device 11 is an ink-jet printer configured to record an image on a sheet 12 (see FIG. 2). The printing device 11 includes a housing 14 having a front wall 14A with the opening 13. As illustrated in FIG. 2, devices arranged in the housing 14 include a sheet supplier 15, a supply tray 20, an output tray 21, a conveying roller unit 54, an image recorder 24, an output roller unit 55, a platen 42, a tank set 99, and an ink-tank holder 120 (see FIGS. 1A and 1B) as one example of a cover. The MFP 10 has various functions such as a facsimile function and a printing function.

Supply Tray 20 and Output Tray 21

As illustrated in FIGS. 1A and 1B, the supply tray 20 is inserted into or removed from the MFP 10 by the user through the opening 13 in the front and rear direction 8. The opening 13 is formed in the front surface of the MFP 10 at its central portion in the right and left direction 9. As illustrated in FIG. 2, the supply tray 20 is configured to support a plurality of the sheets 12 stacked on one another. The output tray 21 is disposed over the supply tray 20. The output tray 21 supports the sheets discharged by the output roller unit 55.

Sheet Supplier 15

The sheet supplier 15 is configured to supply each of the sheets 12 supported on the supply tray 20, to a conveyance path 65. As illustrated in FIG. 2, the sheet supplier 15 includes a supply roller 25, a supply arm 26, and a shaft 27. The supply roller 25 is rotatably supported at a distal end of the supply arm 26. A driving force output from a conveying motor, not illustrated, is applied to the supply roller 25 to rotate the supply roller 25 such that the sheet 12 is conveyed in a conveying direction 16. The supply arm 26 is pivotably supported by the shaft 27 supported on a frame of the printing device 11. The supply arm 26 is urged by, e.g., its own weight or a resilient force of a spring so as to pivot toward the supply tray 20.

Conveyance Path 65

Figure 3:
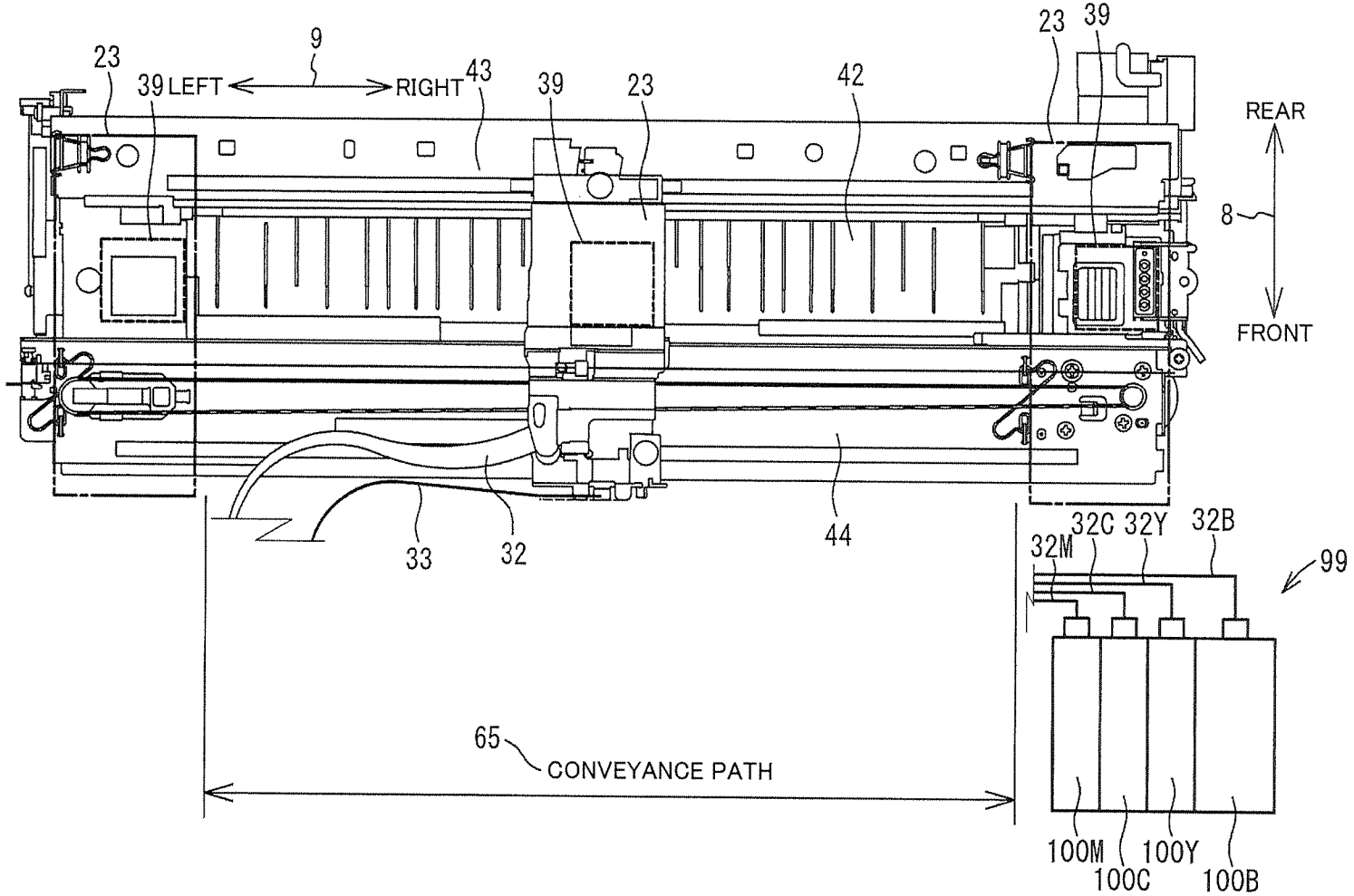
FIG. 3 is a plan view illustrating arrangement of a carriage and a tank set.

As illustrated in FIG. 2, the conveyance path 65 is a space partly defined by an outer guide 18 and an inner guide 19 in the printing device 11. The outer guide 18 and the inner guide 19 are opposed to each other at a predetermined distance therebetween. The conveyance path 65 extends rearward from a rear end portion of the supply tray 20. The conveyance path 65 extends upward, makes a U-turn at a rear portion of the printing device 11 so as to extend frontward, and extends to the output tray 21 via a space located between the image recorder 24 and the platen 42. As illustrated in FIGS. 2 and 3, a portion of the conveyance path 65 which is located between the conveying roller unit 54 and the output roller unit 55 is located at a generally central portion of the MFP 10 in the right and left direction 9 and extends in the front and rear direction 8. In FIG. 2, the one-dot-chain-line arrow indicates the conveying direction 16 in the conveyance path 65.

Conveying Roller Unit 54

As illustrated in FIG. 2, the conveying roller unit 54 is disposed in the conveyance path 65. The conveying roller unit 54 includes a conveying roller 60 and a pinch roller 61 opposed to each other. The conveying roller 60 is driven by the conveying motor. The pinch roller 61 is rotated by rotation of the conveying roller 60. The sheet 12 is conveyed in the conveying direction 16 while being nipped by the conveying roller 60 and the pinch roller 61 rotated by the driving force transmitted from the conveying motor.

Output Roller Unit 55

As illustrated in FIG. 2, the output roller unit 55 is disposed downstream of the conveying roller unit 54 in the conveying direction 16 in the conveyance path 65. The output roller unit 55 includes an output roller 62 and a spur 63 opposed to each other. The output roller 62 is driven by the conveying motor. The spur 63 is rotated by rotation of the output roller 62. The sheet 12 is conveyed in the conveying direction 16 while being nipped by the output roller 62 and the spur 63 rotated by the driving force transmitted from the conveying motor.

Image Recorder 24

As illustrated in FIG. 2, the image recorder 24 is disposed between the conveying roller unit 54 and the output roller unit 55 in the conveying direction 16. The image recorder 24 is opposed to the platen 42 in the up and down direction 7, with the conveyance path 65 interposed therebetween. The image recorder 24 includes a carriage 23 and a recording head 39.

As illustrated in FIG. 3, the carriage 23 is supported by guide rails 43, 44 spaced apart from each other in the front and rear direction 8 and each extending in the right and left direction 9. The guide rails 43, 44 are supported by the frame of the printing device 11. The carriage 23 is coupled to a known belt mechanism provided on the guide rail 44. The belt mechanism is driven by a carriage motor, not illustrated. The carriage 23 coupled to the belt mechanism is reciprocated in the right and left direction 9 by the driving force transmitted from the carriage motor. As indicated by the one-dot chain lines in FIG. 3, the carriage 23 is movable to positions to the right and left of the conveyance path 65.

Ink tubes 32 and a flexible flat cable 33 extend from the carriage 23.

The ink tubes 32 connect the tank set 99 and the recording head 39 to each other. The ink tubes 32 supply, to the recording head 39, ink (as one example of liquid) stored in four ink tanks 100B, 100Y, 100C, 100M constituting the tank set 99. The ink tanks 100B, 100Y, 100C, 100M may be hereinafter collectively referred to as "ink tanks 100". Each of the ink tanks 100 is one example of a tank. Specifically, the four ink tubes 32B, 32Y, 32C, 32M for supply of the ink of four colors, namely, black, magenta, cyan, and yellow, respectively extend from the ink tanks 100B, 100Y, 100C, 100M and are connected to the carriage 23 in a state in which the ink tubes 32B, 32Y, 32C, 32M are bundled together. The four ink tubes 32B, 32Y, 32C, 32M may be hereinafter collectively referred to as "ink tubes 32".

The flexible flat cable 33 electrically connects between the recording head 39 and a control board installed with a controller, not illustrated. The flexible flat cable 33 transmits control signals from the controller to the recording head 39.

As illustrated in FIG. 2, the recording head 39 is mounted on the carriage 23. A multiplicity of nozzles 40 are formed in a lower surface of the recording head 39. Distal ends of the respective nozzles 40 are exposed from the lower surface of the recording head 39. The recording head 39 ejects the ink from the nozzles 40 as fine ink droplets. During movement of the carriage 23, the recording head 39 ejects the ink droplets toward the sheet 12 supported on the platen 42. As a result, an image is recorded on the sheet 12. This image recording consumes the ink stored in the ink tanks 100B, 100Y, 100C, 100M.

Platen 42

As illustrated in FIGS. 2 and 3, the platen 42 is disposed between the conveying roller unit 54 and the output roller unit 55 in the conveying direction 16. The platen 42 is opposed to the image recorder 24 in the up and down direction 7, with the conveyance path 65 interposed therebetween. The platen 42 supports a lower surface of the sheet 12 conveyed by the conveying roller unit 54.

Cover 70

As illustrated in FIG. 1B, an opening 22 is formed in a right portion of the front wall 14A of the housing 14. A cover 70 is attached to the housing 14 so as to cover the opening 22 (see FIG. 1A). As illustrated in FIGS. 1A and 1B, the cover 70 is pivotable between (i) a closing position (indicated in FIG. 1A) at which the cover 70 closes the opening 22 and (ii) an exposing position (indicated in FIG. 1B) at which the cover 70 exposes the opening 22. An opening 97 is formed in the cover 70.

A space is formed at a rear of the opening 22 in the housing 14. The tank set 99 is placed in the space. When the cover 70 is located at the closing position, portions of the ink-tank holder 120 and the ink tanks 100 are visually recognizable from outside through the opening 97.

Tank Set 99

Figure 7A:
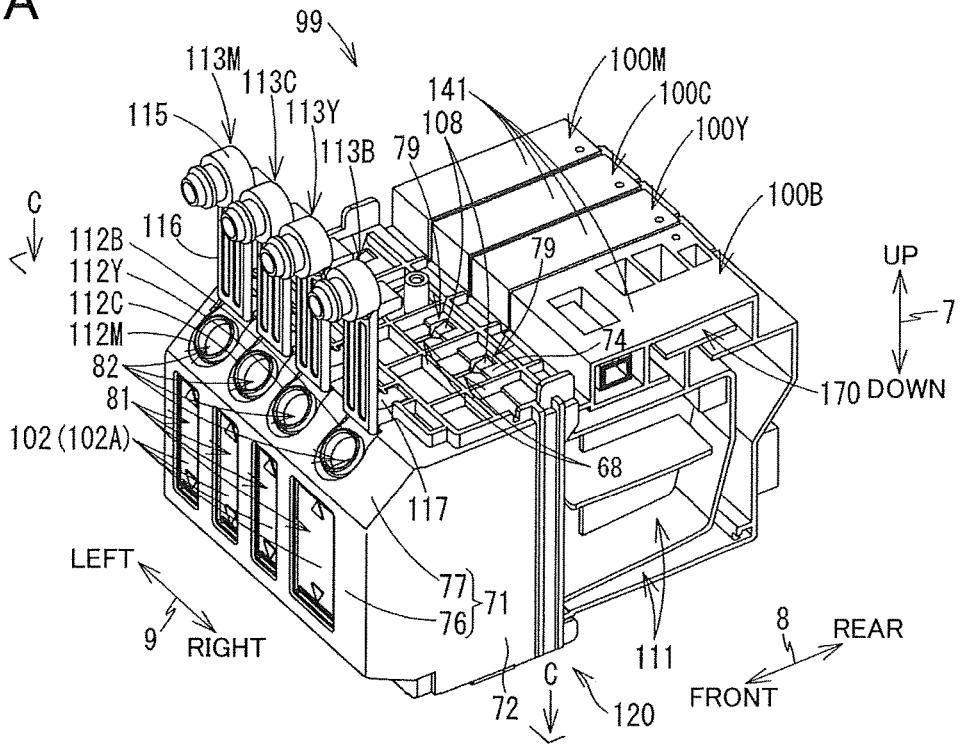
FIG. 7A is a perspective view of the tank set viewed from a front side thereof.
Figure 7B:
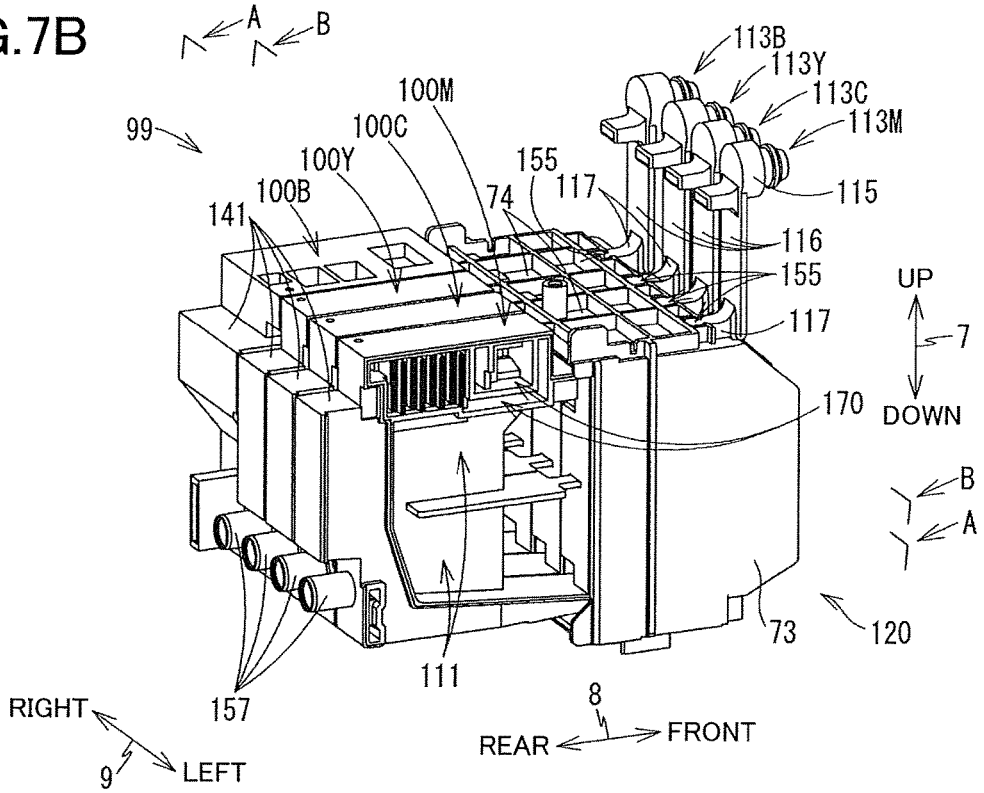
FIG. 7B is a perspective view of the tank set viewed from a rear side thereof.

The tank set 99 stores the ink to be supplied to the recording head 39. As illustrated in FIGS. 7A and 7B, the tank set 99 includes the four ink tanks 100B, 100Y, 100C, 100M and the ink-tank holder 120.

The ink tanks 100 respectively store different colors of the ink. Specifically, the ink tank 100B stores black ink, the ink tank 100Y stores yellow ink, the ink tank 100C stores cyan ink, and the ink tank 100M stores magenta ink. The number of the ink tanks 100 and the colors of the ink are not limited to those in the present embodiment. The constructions of the ink tanks 100 will be described later in detail.

The ink-tank holder 120 is configured to hold the four ink tanks 100B, 100Y, 100C, 100M in a state in which the ink tanks 100B, 100Y, 100C, 100M are arranged in a row in the right and left direction 9. The construction of the ink-tank holder 120 will be described later in detail.

The four ink tanks 100B, 100Y, 100C, 100M are arranged in a row in the right and left direction 9. The ink tank 100B is disposed at the rightmost position, and the ink tank 100M is at the leftmost position among the four ink tanks 100B, 100Y, 100C, 100M. It is noted that the arrangement of the ink tanks 100 is not limited to that in the present embodiment. The ink tank 100B is greater than each of the ink tanks 100Y, 100C, 100M in size, in particular, in width in the right and left direction 9. The size relationship among the ink tanks 100 is not limited to that in the present embodiment. The ink tank 100B is greater than each of the ink tanks 100Y, 100C, 100M in the maximum amount of the ink storable in the ink tank 100. This relationship is not limited to that in the present embodiment.

As illustrated in FIGS. 1A and 1B, the tank set 99 is disposed in a front right portion of the housing 14. In other words, the tank set 99 is secured to the MFP 10 so as not to be readily removed from the MFP 10. It is noted that the wordings "not to be readily removed" means that the user cannot easily remove the tank set 99 from the housing 14 of the MFP 10 in a normal use state, for example. This meaning excludes such a case that a skilled person removes the tank set 99 from the housing 14 of the MFP 10 for repair. Thus, it is at least required that the user cannot easily remove the tank set 99 from the housing 14 of the MFP 10 in the normal use state.

Ink Tanks 100

There will be next described the configurations of the ink tanks 100. Since the ink tanks 100Y, 100C, 100M are the same in construction, the ink tanks 100Y, 100C, 100M may be hereinafter collectively referred to as "ink tanks Co", and the construction of one of the ink tanks Co will be described unless otherwise required in context. Since the ink tank 100B is similar in construction to the ink tank Co, the construction of a portion of the ink tank 100B which is different in construction from the ink tank Co will be described after the description of the construction of the ink tank Co. In the following description, the same reference numerals are used for elements of the ink tank 100B and the ink tank Co which have similar functions even if the elements are different in shape from each other. In the following description, the MFP 10 and the ink tanks 100 placed in the MFP 10 are in the use orientation unless otherwise required in context.

Figure 4A:
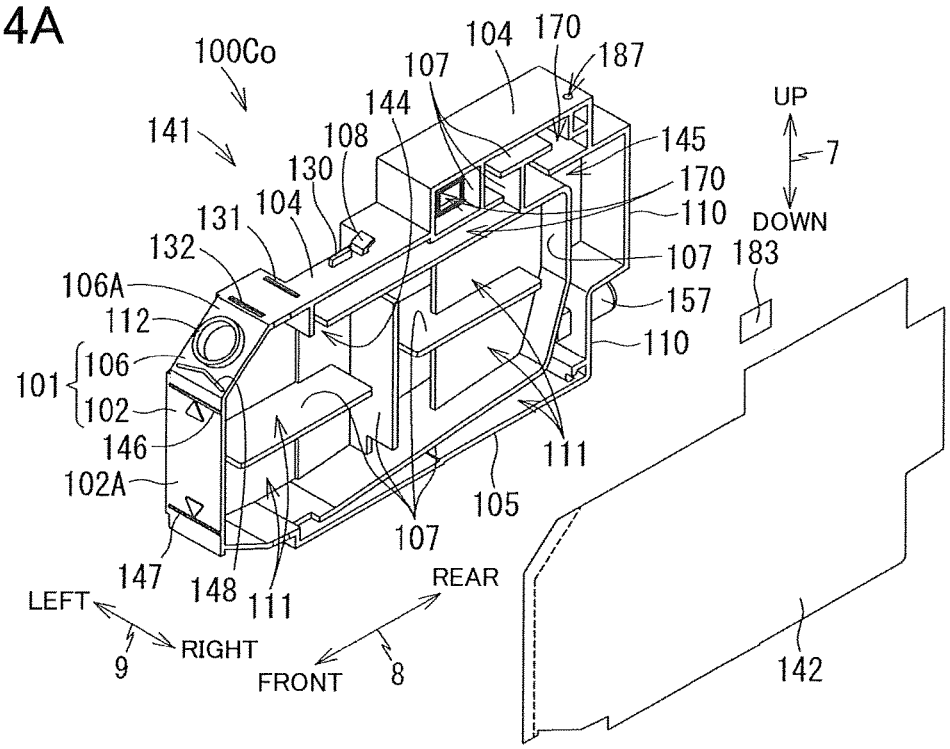
FIG. 4A is a perspective view of an ink tank for color ink, viewed from a front side thereof.
Figure 4B:
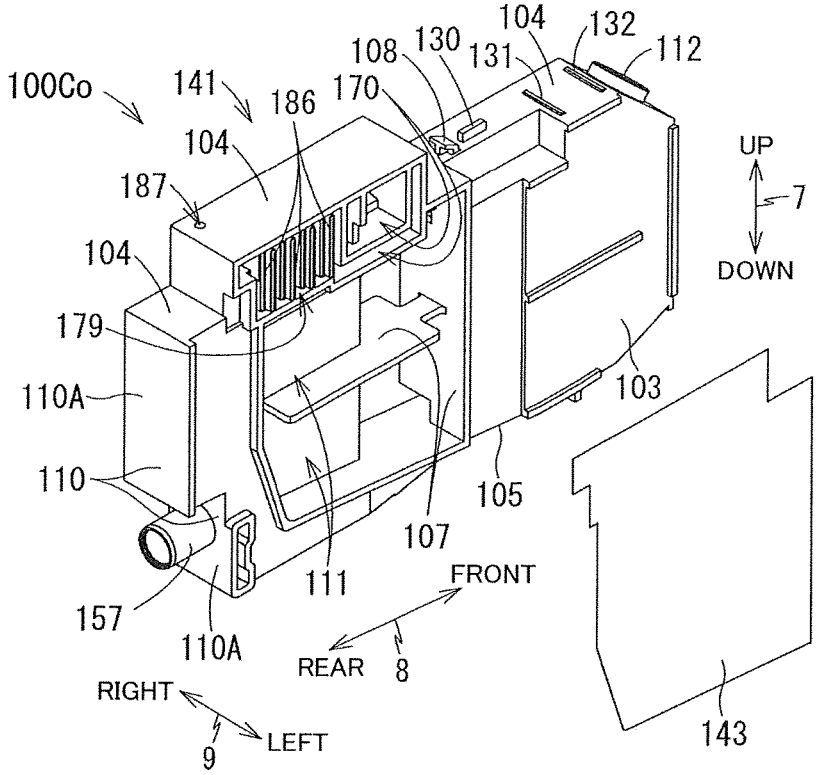
FIG. 4B is a perspective view of the ink tank viewed from a rear side thereof.

As illustrated in FIGS. 4A and 4B, the ink tank 100Co includes a frame 141 which forms an outer shape of the ink tank Co.

In general, the frame 141 has a flat rectangular parallelepiped shape in which the dimension of the frame 141 in the right and left direction 9 is short, and each of the dimensions of the frame 141 in the up and down direction 7 and the front and rear direction 8 is greater than that of the frame 141 in the right and left direction 9. The dimension of the frame 141 in the front and rear direction 8 is greater than that of the frame 141 in the up and down direction 7.

The frame 141 is formed of resin having such light transparency that the ink in an ink chamber 111 is visually recognizable from the outside of the ink tank 100Co. For example, the frame 141 is formed of polypropylene. The frame 141 is formed as one piece by injection molding of a resin material, for example.

It is noted that the frame 141 may be constituted by a plurality of components combined with one another.

The frame 141 includes a front wall 101, a right wall 159 as one example of a side wall, a left wall 103, an upper wall 104, a lower wall 105, a rear wall 110, and inner walls 107.

The front wall 101 includes a standing wall 102 (as one example of a first wall) and an inclined wall 106 (as one example of a second wall). The standing wall 102 extends in the up and down direction 7 and the right and left direction 9. The inclined wall 106 couples an upper end of the standing wall 102 and a front end of the upper wall 104 to each other. That is, the inclined wall 106 is provided over and continuous to the standing wall 102. The inclined wall 106 is inclined with respect to each of the up and down direction 7 and the front and rear direction 8.

A front surface 102A of the standing wall 102 and a front surface 106A of the inclined wall 106 (i.e., a front surface of the frame 141 of the ink tank 100Co) are exposed to the outside of the MFP 10 via the opening 97 of the cover 70 and the opening 22 of the housing 14. That is, the ink tanks 100Co are disposed in the housing 14 such that a front portion of the frame 141 of each of the ink tanks 100Co is accessible from a front side of the housing 14 through the opening 22 and the opening 97. This configuration enables the user to visually recognize the front surface of the frame 141 of the ink tank 100Co from a front side of the MFP 10 to check a remaining amount of the ink stored in the ink tank 100Co.

The left wall 103 extends rearward from a left end of the front wall 101. An upper end of the left wall 103 is connected to a front portion of the upper wall 104. A lower end of the left wall 103 is connected to a front portion of the lower wall 105. In other words, the left wall 103 couples the left end of the front wall 101, a left end of a front portion of the upper wall 104, and a left end of a front portion of the lower wall 105 to each other. That is, the left wall 103 is provided only in the front portion of the frame 141 and not provided in a rear portion of the frame 141.

The upper wall 104 extends rearward from an upper end of the front wall 101 (i.e., a rear end of the inclined wall 106). The front portion of the upper wall 104 is connected to the upper end of the left wall 103.

The lower wall 105 extends rearward from a lower end of the front wall 101. The lower wall 105 is located under the upper wall 104 with a space therebetween. As described above, the front portion of the lower wall 105 is connected to the lower end of the left wall 103.

The inner walls 107 are arranged in a space surrounded with the front wall 101, the left wall 103, the upper wall 104, the lower wall 105, and the rear wall 110.

Figure 6:
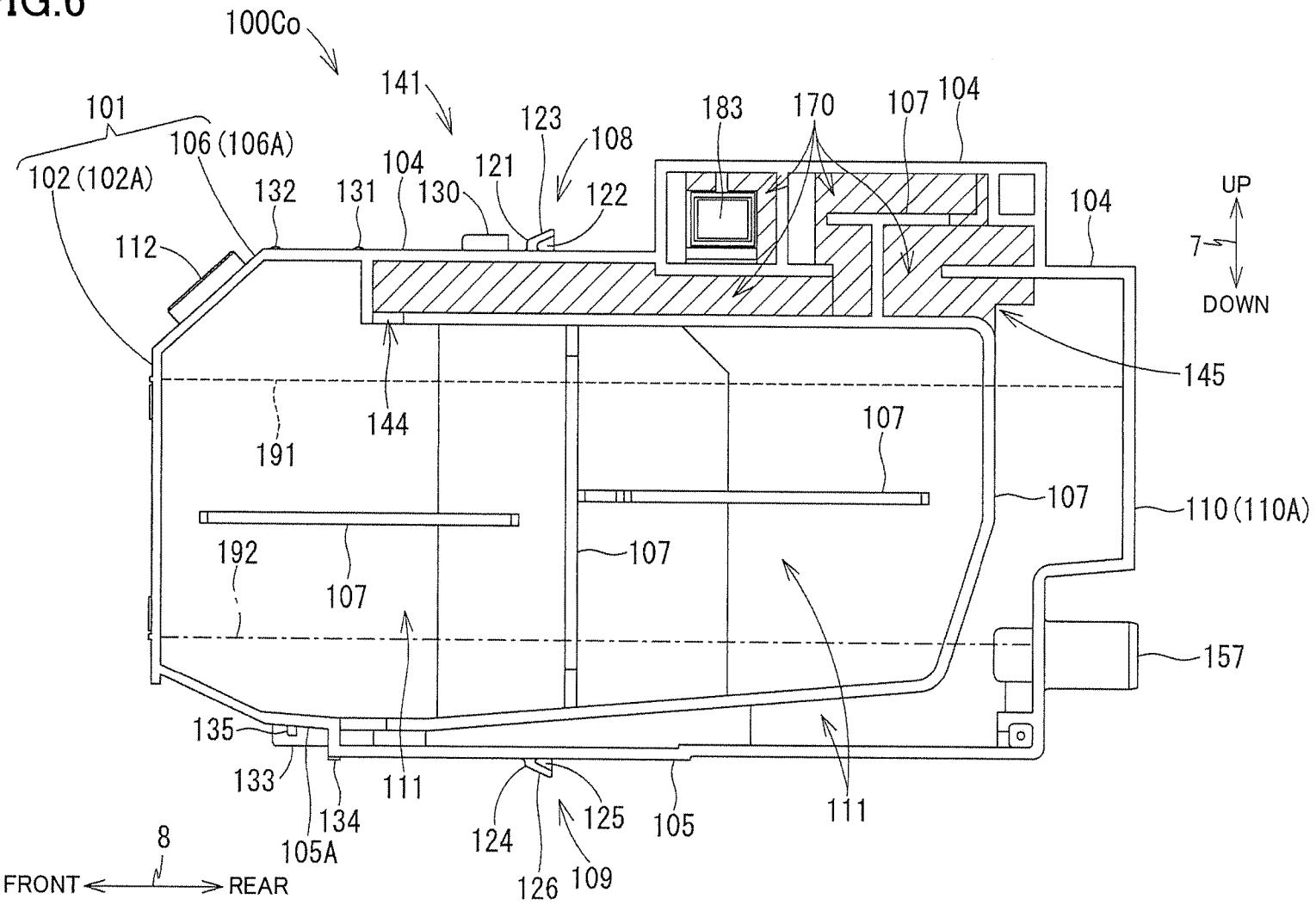
FIG. 6 is a right side view of the ink tank for color ink.

As illustrated in FIGS. 4A, 4B, and 6, a protrusion 108 is formed on the upper wall 104. As illustrated in FIG. 6, the protrusion 108 includes a plate portion 121 and a rib 122. The plate portion 121 has an inclined surface 123 inclined so as to be higher at its rear portion than at its front portion. The rib 122 is disposed so as to connect the plate portion 121 and the upper wall 104 to each other. The rib 122 is shorter than the plate portion 121 in the right and left direction 9. With this configuration, the protrusion 108 is bent downward when a force in at least one of the rear direction or the down direction is applied to the inclined surface 123.

As illustrated in FIG. 6, a protrusion 109 is formed on the lower wall 105. The protrusion 109 includes a plate portion 124 and a rib 125. The plate portion 124 has an inclined surface 126 so as to be lower at its rear portion than at its front portion. The rib 125 is disposed so as to connect the plate portion 124 and the lower wall 105 to each other. The rib 125 is shorter than the plate portion 124 in the right and left direction 9. With this configuration, the protrusion 109 is bent upward when a force in at least one of the rear direction or the up direction is applied to the inclined surface 126.

As illustrated in FIGS. 4A, 4B, and 6, a protrusion 130 is formed on the upper wall 104. The protrusion 130 is located in front of the protrusion 108. The protrusion 130 extends in the front and rear direction 8.

Protrusions 131, 132 are formed on the upper wall 104. The protrusions 131, 132 are located in front of the protrusion 130. The protrusion 132 is located in front of the protrusion 131. Each of the protrusions 131, 132 extends in the right and left direction 9.

As illustrated in FIG. 6, a protrusion 133 is formed on the lower wall 105. The protrusion 133 is formed on a subsidiary lower wall 105A. The subsidiary lower wall 105A is formed on the front portion of the lower wall 105 and located above the lower wall 105.

A protrusion 134 is formed on the lower wall 105. The protrusion 134 is located in front of the protrusion 109. The protrusion 134 extends in the right and left direction 9.

A protrusion 135 is formed on the subsidiary lower wall 105A. The protrusion 135 extends in the right and left direction 9. In the present embodiment, the protrusion 135 extends rightward and leftward from the protrusion 133. The length (protruding length) of the protrusion 135 is less than the length (protruding length) of the protrusion 133. That is, a protruding end of the protrusion 135 is located above a protruding end of the protrusion 133.

Films 142, 143

As illustrated in FIG. 4A, the frame 141 is open on its right side. A film 142 is welded to right surfaces of the front wall 101, the lower wall 105, the rear wall 110, the upper wall 104, and the inner walls 107 to seal the frame 141 from its right side. The stiffness of the frame 141 is greater than that of the film 142.

As illustrated in FIG. 4B, a rear portion of the frame 141 is open on its left side. A film 143 is welded to left surfaces of the lower wall 105, the rear wall 110, the upper wall 104, and the inner walls 107 to seal the frame 141 from its left side. The stiffness of the frame 141 is greater than that of the film 143.

As illustrated in FIGS. 4A and 4B, each of the films 142, 143 extends in the up and down direction 7 and the front and rear direction 8. As illustrated in FIG. 4A, the film 142 is longer than a right portion of the frame 141 in the front and rear direction 8. A portion of the film 142 which is indicated by the broken line in FIG. 4A corresponds to a right surface of the front wall 101 in the film 142 is welded to a right surface of the frame 141.

In the state in which the film 142 is welded to the right surface of the frame 141, the film 142 extends from right ends (each as one example of one end) of the standing wall 102 and the inclined wall 106 in the rear direction that is directed along the horizontal direction and intersects the right and left direction 9.

Figure 12:
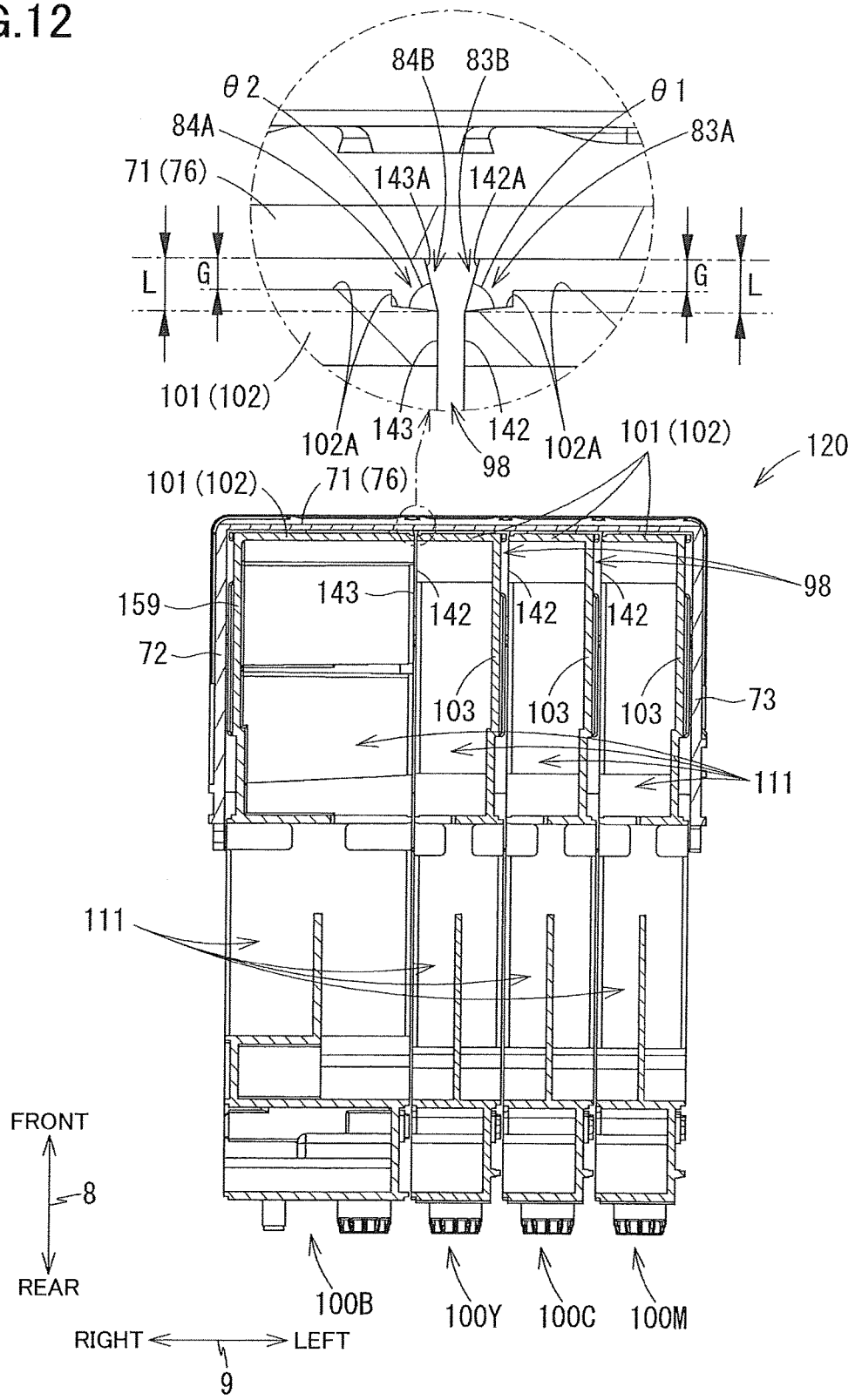
FIG. 12 is a cross-sectional view taken along line C-C in FIG. 7A.
Figure 13:
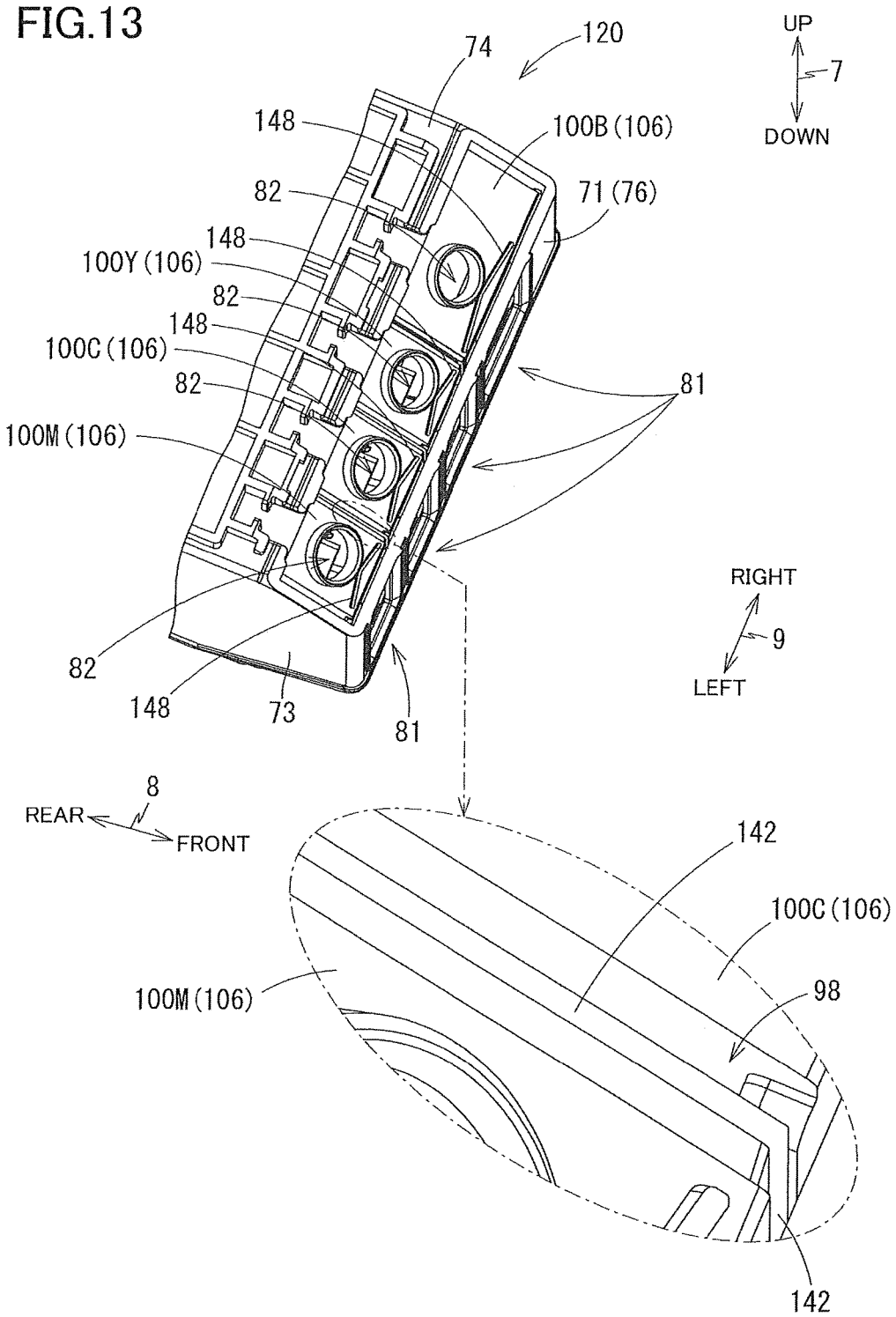
FIG. 13 is a cross-sectional view of the tank set and the ink-tank holder, with an inclined wall cut out along a plane parallel with an outer surface of the inclined wall in FIG. 7A.

As illustrated in FIGS. 12 and 13, the film 142 protrudes frontward toward the ink-tank holder 120 from the right ends of the standing wall 102 and the inclined wall 106 in the state in which the film 142 is welded to the right surface of the frame 141. In the present embodiment, the film 142 protrudes from the standing wall 102 toward a standing wall 76 of the ink-tank holder 120 and protrudes from the inclined wall 106 toward an inclined wall 77 of the ink-tank holder 120 in the state in which the film 142 is welded to the right surface of the frame 141.

As illustrated in FIG. 12, the film 142 protrudes obliquely frontward and leftward from the standing wall 102 and the inclined wall 106. A portion of the film 142 which protrudes from the front wall 101 (the standing wall 102 and the inclined wall 106) has opposite surfaces. One of these opposite surfaces which is located nearer to the standing wall 102 is a left surface 142A. The angle θ1 between the left surface 142A and the front surface 102A (as one example of an outer surface) of the standing wall 102 is an acute angle.

The protruding length of the film 142 in the front and rear direction 8, i.e., the length of the portion of the film 142 which protrudes from the standing wall 102, is a length L as one example of a protruding length. The film 142 protrudes from the standing wall 102 and the inclined wall 106 by the same length. Specifically, a distal end of the film 142 which protrudes from the inclined wall 106 extends parallel with the front surface 106A of the inclined wall 106, and a distal end of the film 142 which protrudes from the standing wall 102 extends parallel with the front surface 102A of the standing wall 102. The length L is large enough for the distal end of the protruding portion of the film 142 to contact the ink-tank holder 120.

It is noted that the protruding length (the length L) of each of the films 142, 143 is not limited to that illustrated in FIG. 12. For example, the protruding length (the length L) of each of the films 142, 143 may be greater than that illustrated in FIG. 12.

Ink Chamber 111

As illustrated in FIGS. 4A and 4B, the frame 141 has the ink chamber 111 (as one example of a liquid storage chamber) therein. The ink chamber 111 is an inner space of the ink tank 100Co and stores the ink.

The ink chamber 111 is divided by the front wall 101, the left wall 103, the upper wall 104, the lower wall 105, the rear wall 110, the inner walls 107, the film 142, and the film 143.

A front end of the ink chamber 111 is defined by a rear surface of the front wall 101. A rear end of the ink chamber 111 is defined by a front surface of the rear wall 110. An upper end of the ink chamber 111 is defined by a lower surface of the upper wall 104. A lower end of the ink chamber 111 is defined by an upper surface of the lower wall 105. A right end of the ink chamber 111 is defined by a left surface (as one example of a first side surface) of the film 142. A left end of the ink chamber 111 is defined by a right surface of the left wall 103 and a right surface of the film 143. The ink chamber 111 is partitioned by the inner walls 107 into a plurality of portions.

It is noted that the right end of the ink chamber 111 may be defined by the film 142 and a wall. That is, a portion of the right end of the ink chamber 111 may be constituted by the film 142. In this case, the left surface of the film 142 and a left surface of the wall are one example of the first side surface. The left end of the ink chamber 111 may be defined only by the film 143. That is, the entire left end of the ink chamber 111 may be constituted by the film 143. Also, the MFP 10 may be configured such that the right end of the ink chamber 111 is constituted only by the film 142, and the left end of the ink chamber 111 is constituted only by the film 143.

Protrusion 157

A protrusion 157 is a hollow member protruding rearward from the rear wall 110. An inner space of the protrusion 157 communicates with the ink chamber 111. The protrusion 157 is directly or indirectly connected to the ink tube 32 (see FIG. 3). Thus, the ink supplied from the ink chamber 111 to the inner space of the protrusion 157 flows to the ink tube 32.

In view of the above, the ink stored in the ink chamber 111 communicates with the nozzles 40 of the recording head 39 via the inner space of the protrusion 157 and the ink tube 32. It is noted that the protrusion 157 may not be directly connected to the ink tube 32. For example, a needle connected at its one end portion to the ink tube 32 may be inserted at the other end portion into the protrusion 157.

Atmosphere Communication Passage 170

As illustrated in FIGS. 4A, 4B, and 6, the frame 141 has an atmosphere communication passage 170. The atmosphere communication passage 170 establishes communication between the ink chamber 111 and the outside of the ink tank 100Co. In other words, the atmosphere communication passage 170 establishes communication of the ink chamber 111 with atmosphere.

One end of the atmosphere communication passage 170 communicates with the ink chamber 111 via openings 144, 145. The other end of the atmosphere communication passage 170 communicates with an atmosphere opening 187 formed in the upper wall 104.

As illustrated in FIG. 6, a semipermeable membrane 183 is bonded between the one end and the other end of the atmosphere communication passage 170 so as to close the atmosphere communication passage 170. The semipermeable membrane 183 is a porous layer having fine holes which inhibits the ink from passing through the semipermeable membrane 183 and permits gas to pass through the semipermeable membrane 183. For example, the semipermeable membrane 183 is formed of fluoropolymers (fluororesin) such as polytetrafluoroethylene, polychlorotrifluoroethylene, tetrafluoroethylene-hexafluoropropylene copolymer, tetrafluoroethylene-perfluoroalkylvinylether copolymer, and tetrafluoroethylene-ethylene copolymer. Thus, the ink stored in the ink chamber 111 is blocked by the semipermeable membrane 183 so as not to flow to the outside of the ink tank 100Co through the atmosphere opening 187. Air is freely movable between the inside of the ink chamber 111 and the outside of the ink tank 100Co.

As illustrated in FIG. 4B, a labyrinth 179 is formed between the atmosphere opening 187 and a portion of the atmosphere communication passage 170 at which the semipermeable membrane 183 is bonded. The labyrinth 179 is a communication passage defined by separation walls 186 arranged in the front and rear direction 8 and each extending in the up and down direction 7. The labyrinth 179 extends in the front and rear direction 8 while making a plurality of U-turns in the up and down direction 7.

Ink Tank 100B

Figure 5A:
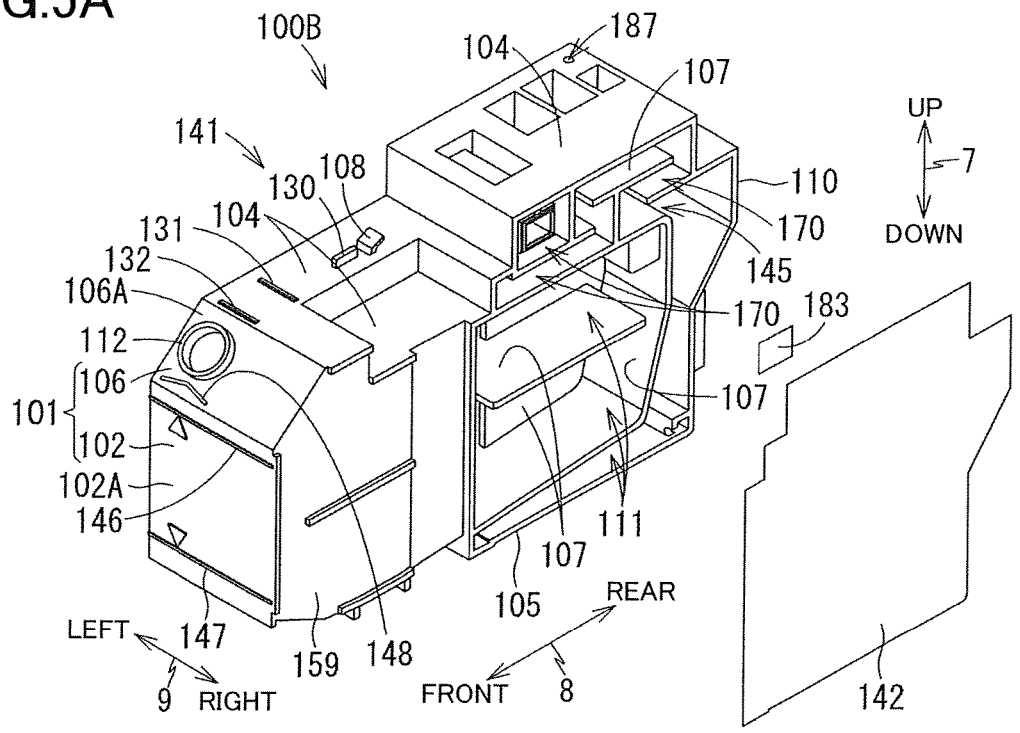
FIG. 5A is a perspective view of an ink tank for black ink, viewed from a front side thereof.
Figure 5B:
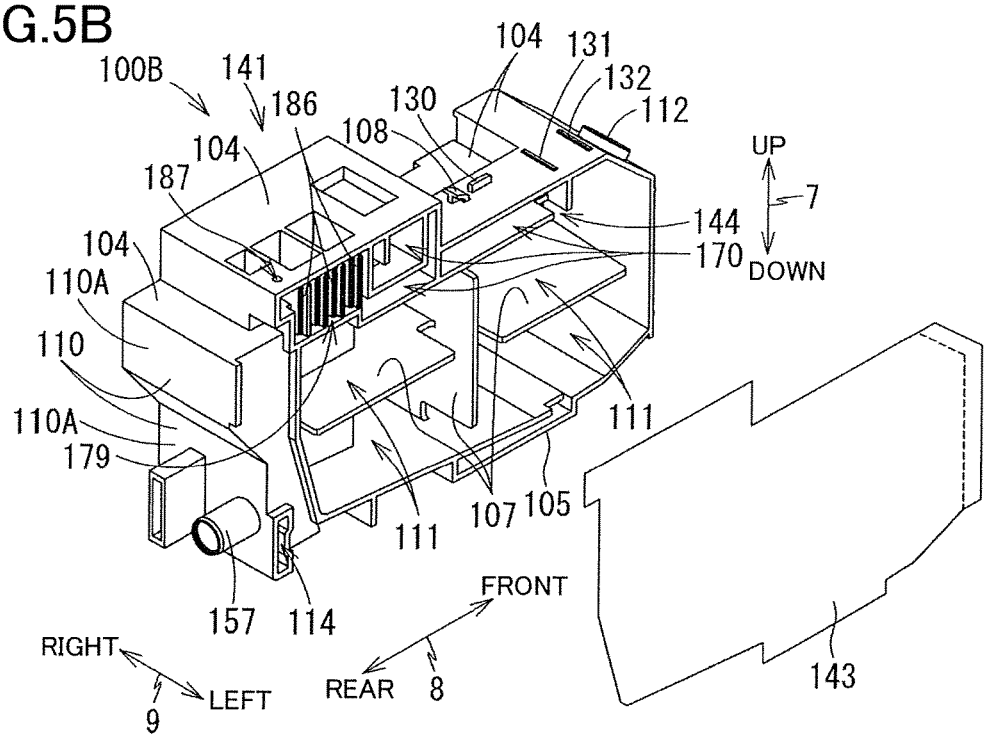
FIG. 5B is a perspective view of the ink tank for black ink, viewed from a rear side thereof.

There will be next described the construction of the ink tank 100B with reference to FIGS. 5A and 5B. As illustrated in FIGS. 5A and 5B, the ink tank 100B is longer than the ink tank Co (see FIGS. 4A and 4B) in the right and left direction 9.

There will be described portions of the ink tank 100B which are different in construction from the ink tank 100Co. It is noted that the same reference numerals as used in the ink tank 100Co are used to designate the corresponding elements of the ink tank 100B, and an explanation of which is dispensed with. In the case where a certain portion of the ink tank 100B and a portion of the ink tank 100Co which corresponds to the certain portion are different in construction from each other only in that the certain portion of the ink tank 100B is longer than the portion of the ink tank 100Co in the right and left direction 9, the same reference numeral as used in FIGS. 4A and 4B is used for the certain portion of the ink tank 100B, and an explanation thereof is omitted.

As illustrated in FIG. 5A, the ink tank 100B does not include the left wall 103 (see FIG. 4B) of the ink tank 100Co and includes the right wall 159. The right wall 159 extends rearward from a right end of the front wall 101. An upper end of the right wall 159 is connected to the front portion of the upper wall 104. A lower end of the right wall 159 is connected to the front portion of the lower wall 105. In other words, the right wall 159 couples the right end of the front wall 101, a front right end of the upper wall 104, and a front right end of the lower wall 105 to each other. That is, the right wall 159 is provided only in the front portion of the frame 141 and not provided in the rear portion of the frame 141.

The frame 141 is open on its left side. The film 143 is welded to the left surfaces of the front wall 101, the lower wall 105, the rear wall 110, the upper wall 104, and the inner walls 107 to seal the frame 141 from its left side.

As illustrated in FIG. 5B, a rear portion of the frame 141 is open on its right side. A film 142 is welded to the right surfaces of the lower wall 105, the rear wall 110, the upper wall 104, and the inner walls 107 to seal the frame 141 from its right side.

The film 143 extends rearward from left ends (each as one example of the other end) of the standing wall 102 and the inclined wall 106.

In a state in which the film 143 is welded to the left surface of the frame 141 of the ink tank 100B, as illustrated in FIG. 12, like the film 142 of the ink tank 100Co, the film 143 protrudes from the left ends of the standing wall 102 and the inclined wall 106 by the length L in the front direction toward the standing wall 76 and the inclined wall 77 of the ink-tank holder 120.

The film 143 welded to the ink tank 100B protrudes obliquely frontward and rightward from the standing wall 102 and the inclined wall 106. A portion of the film 143 which protrudes from the front wall 101 (the standing wall 102 and the inclined wall 106) has opposite surfaces. One of these opposite surfaces which is located nearer to the standing wall 102 is a right surface 143A. The angle θ2 between the right surface 143A and the front surface 102A of the standing wall 102 is an acute angle.

The left end of the ink chamber 111 of the ink tank 100B is defined by the right surface (as one example of the second side surface) of the film 143. A right end of the ink chamber 111 of the ink tank 100B is defined by a left surface of the right wall 159 and a left surface of the film 142.

It is noted that the left end of the ink chamber 111 of the ink tank 100B may be defined by the film 143 and a wall. That is, the left end of the ink chamber 111 may be partly constituted by the film 143. In this case, the right surface of the film 143 and a right surface of the wall are one example of the second side surface. The right end of the ink chamber 111 may be defined only by the film 142. That is, the entire right end of the ink chamber 111 may be constituted by the film 142. The MFP 10 may be configured such that the left end of the ink chamber 111 is constituted only by the film 143, and the right end of the ink chamber 111 is constituted only by the film 142.

Supply Openings 112

As illustrated in FIG. 7A, supply openings 112B, 112Y, 112C, 112M are formed in the inclined walls 106 of the respective ink tanks 100B, 100Y, 100C, 100M. It is noted that the supply openings 112B, 112Y, 112C, 112M may be hereinafter collectively referred to as "supply openings 112". Each of the supply openings 112 is for supplying the ink to the ink chamber 111. The supply opening 112 extends through the inclined wall 106 in its thickness direction and thereby establishes communication between the ink chamber 111 and the outside of the ink tank 100.

When the cover 70 is located at the exposing position, the inclined wall 106 and the supply opening 112 are exposed to the outside of the MFP 10 through the opening 22. An orientation (a supply orientation) of the ink tank 100 when the ink is supplied to the ink chamber 111 via the supply opening 112 is a use orientation. That is, when the ink tank 100 is in the use orientation, the ink is supplied to the ink chamber 111 via the supply opening 112.

Ink-Tank Holder 120

As illustrated in FIGS. 7A and 7B, the ink-tank holder 120 is configured to hold the four ink tanks 100B, 100Y, 100C, 100M in the state in which the ink tanks 100B, 100Y, 100C, 100M are arranged in a row in the right and left direction 9.

Figure 8A:
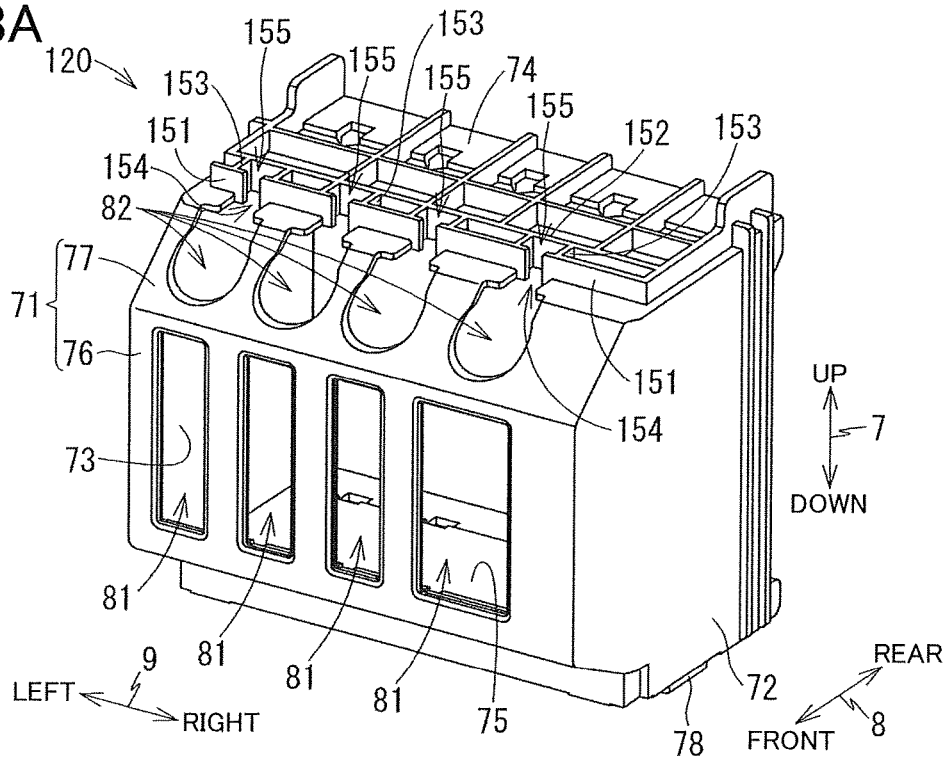
FIG. 8A is a perspective view of an ink-tank holder viewed from a front side thereof.
Figure 8B:
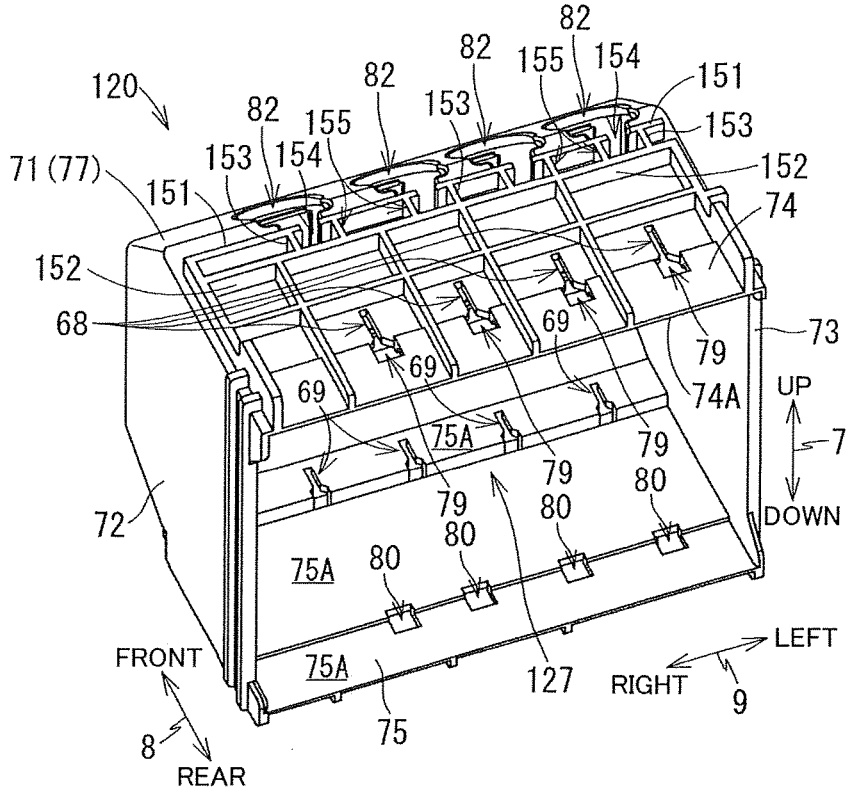
FIG. 8B is a perspective view of the ink-tank holder viewed from a rear side thereof.

As illustrated in FIGS. 8A and 8B, the ink-tank holder 120 includes a front wall 71, a right wall 72, a left wall 73, an upper wall 74, and a lower wall 75.

The front wall 71 includes the standing wall 76 (as one example of a third wall) and the inclined wall 77. The standing wall 76 extends in the up and down direction 7 and the right and left direction 9. The inclined wall 77 couples an upper end of the standing wall 76 and a front end of the upper wall 74 to each other. The inclined wall 77 is inclined with respect to the up and down direction 7 and the front and rear direction 8.

The right wall 72 extends rearward from a right end of the front wall 71. The left wall 73 extends rearward from a left end of the front wall 71. The upper wall 74 extends rearward from an upper end of the front wall 71 (specifically, an upper end of the inclined wall 77). A right end of the upper wall 74 is connected to an upper end of the right wall 72. A left end of the upper wall 74 is connected to an upper end of the left wall 73. The lower wall 75 extends rearward from a lower end of the front wall 71. A right end of the lower wall 75 is connected to a lower end of the right wall 72. A left end of the lower wall 75 is connected to a lower end of the left wall 73.

Figure 9:
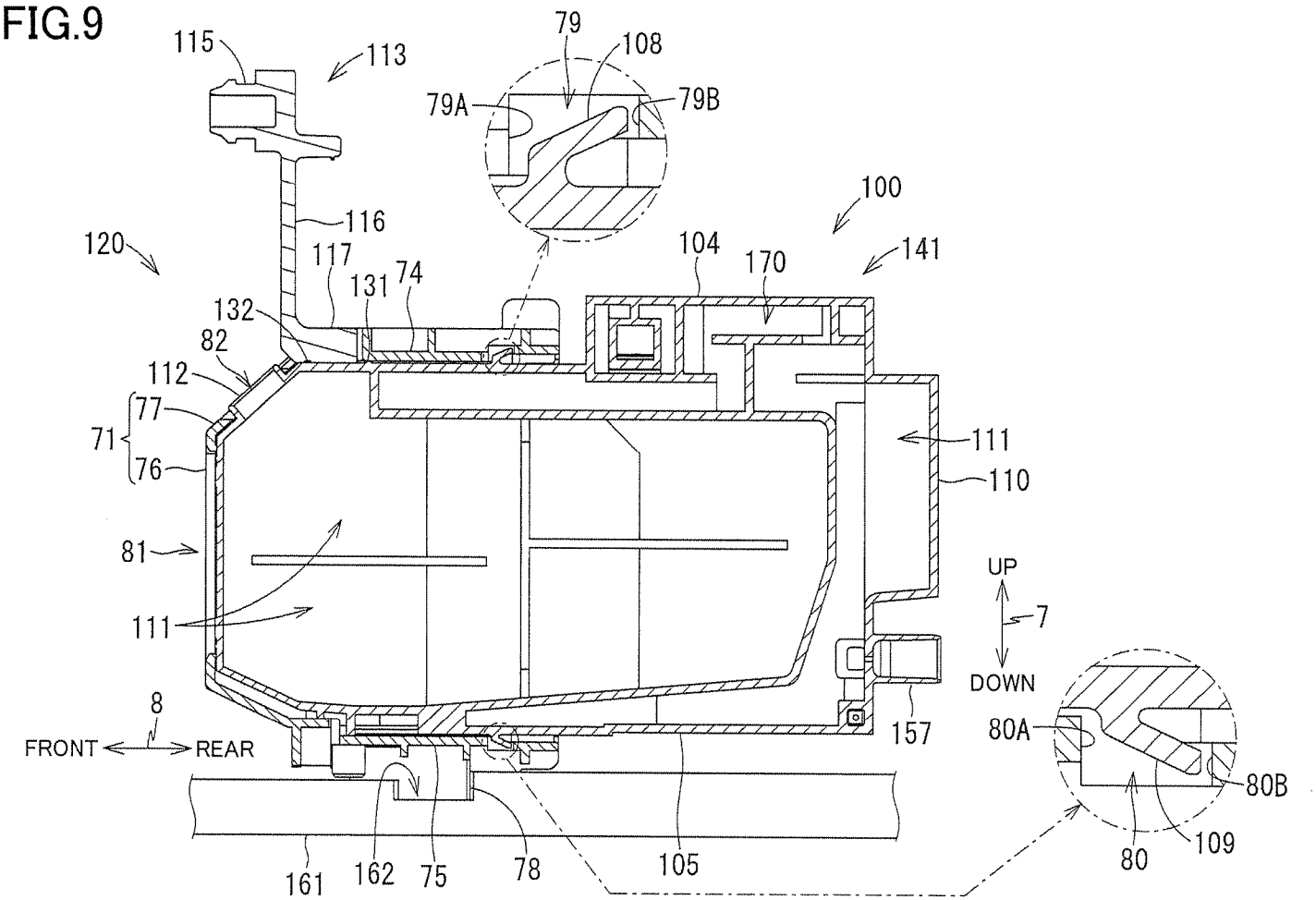
FIG. 9 is an elevational view in vertical cross section illustrating the ink tank and the ink-tank holder.
Figure 11A:
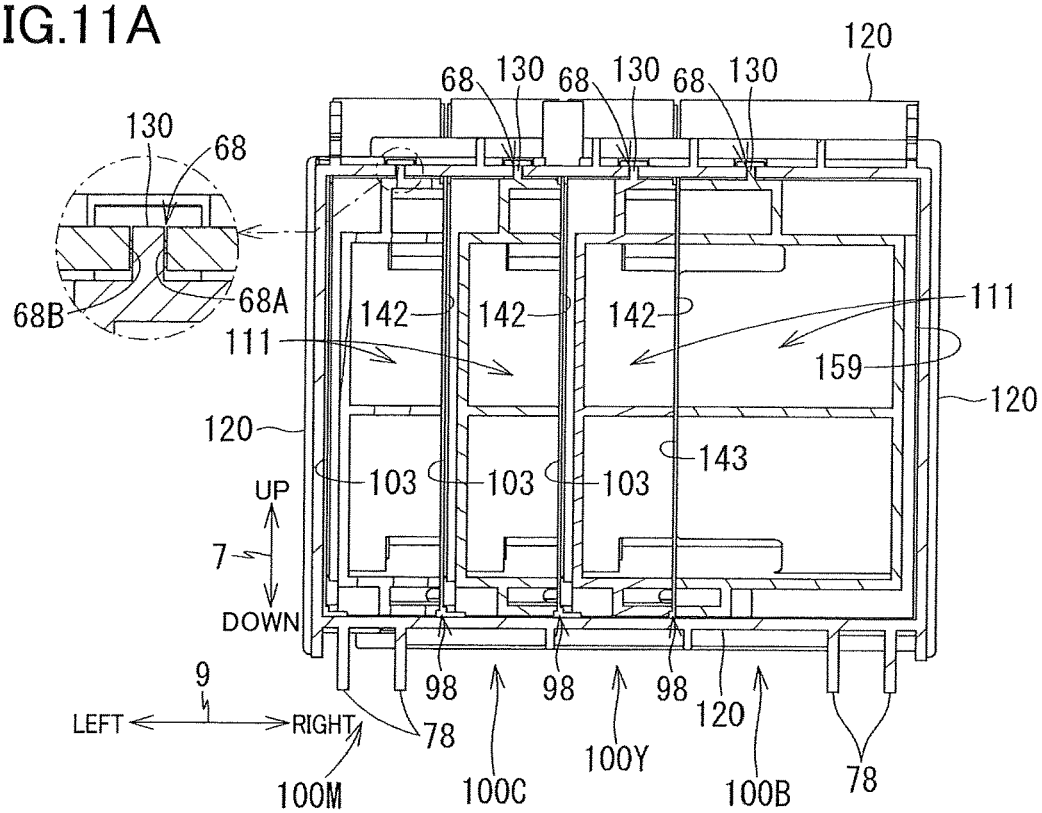
FIG. 11A is a cross-sectional view taken along line A-A in FIG. 7B.
Figure 11B:
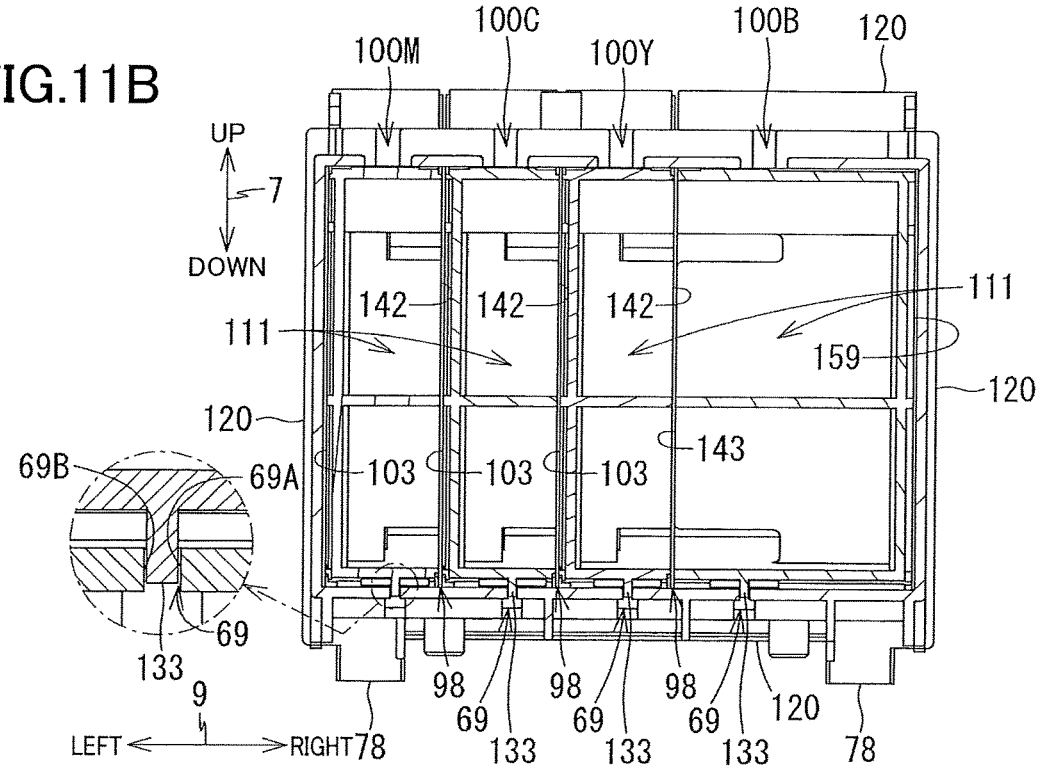
FIG. 11B is a cross-sectional view taken along line B-B in FIG. 7B.

As illustrated in FIG. 9, the ink-tank holder 120 includes protrusions 78 extending downward from the lower wall 75. As illustrated in FIGS. 11A and 11B, the protrusions 78 are respectively formed on right and left end portions of the lower wall 75. As illustrated in FIG. 9, the protrusions 78 are respectively inserted into holes 162 formed in a bottom plate 161 of the housing 14 of the printing device 11. With this insertion, the ink-tank holder 120 is secured to and supported by the housing 14.

The ink-tank holder 120 is secured to and supported by the housing 14 in a state in which the ink tanks 100 are held by the ink-tank holder 120 (i.e., a state illustrated in FIGS. 7A and 7B).

As illustrated in FIG. 8B, the front wall 71, the right wall 72, the left wall 73, the upper wall 74, and the lower wall 75 define an inner space 127 of the ink-tank holder 120. As illustrated in FIGS. 7A and 7B, the four ink tanks 100B, 100Y, 100C, 100M are inserted into the inner space 127 from a rear side thereof. As a result, front portions of the four ink tanks 100B, 100Y, 100C, 100M are located in the inner space 127.

As illustrated in FIG. 8B, a rear portion of the upper wall 74 has a plurality of openings 79. The openings 79 respectively correspond to the four ink tanks 100B, 100Y, 100C, 100M. That is, four openings 79 are formed in the present embodiment. The openings 79 are respectively formed at positions corresponding to the protrusions 108 of the respective ink tanks 100 (see FIGS. 4A-6) in the state in which the ink tanks 100 are inserted in the inner space 127.

A rear portion of the lower wall 75 has a plurality of openings 80. The openings 80 respectively correspond to the four ink tanks 100B, 100Y, 100C, 100M. That is, four openings 80 are formed in the present embodiment. The openings 80 are respectively formed at positions corresponding to the protrusions 109 of the respective ink tanks 100 (see FIG. 6) in the state in which the ink tanks 100 are inserted in the inner space 127.

The upper wall 74 has a plurality of openings 68. The openings 68 extend frontward from the respective openings 79. That is, four openings 68 are formed in the present embodiment. The openings 68 are respectively formed at positions corresponding to the protrusions 130 of the respective ink tanks 100 (see FIG. 6) in the state in which the ink tanks 100 are inserted in the inner space 127.

The lower wall 75 has a plurality of openings 69. The openings 69 respectively correspond to the four ink tanks 100B, 100Y, 100C, 100M. That is, four openings 69 are formed in the present embodiment. The openings 69 are located in front of the respective openings 80. Each of the openings 69 extends in the front and rear direction 8. The openings 69 are respectively formed at positions corresponding to the protrusions 133 of the respective ink tanks 100 (see FIG. 6) in the state in which the ink tanks 100 are inserted in the inner space 127.

In a process in which the ink tanks 100 are inserted into the inner space 127, the protrusions 108 are brought into contact with a surface 74A of the upper wall 74 near the inner space 127 and bent downward by being pressed against the surface 74A. The protrusions 109 are brought into contact with a surface 75A of the lower wall 75 near the inner space 127 and bent upward by being pressed against the surface 75A. When the ink tanks 100 are further inserted, the protrusions 108 are inserted in the respective openings 79, and the protrusions 109 are inserted in the respective openings 80. This unbends the protrusions 108, 109.

In this state, as illustrated in FIG. 9, the protrusions 108 are engaged with the respective openings 79, and the protrusions 109 are engaged with the respective openings 80.

When the ink tanks 100 are moved frontward with respect to the ink-tank holder 120 in the state in which the protrusions 108 and the respective openings 79 are engaged with each other, the protrusions 108 are respectively brought into contact with front edge faces 79A defining front ends of the respective openings 79. This contact restricts frontward movement of the ink tanks 100 with respect to the ink-tank holder 120. When the ink tanks 100 are moved rearward with respect to the ink-tank holder 120 in the state in which the protrusions 108 and the respective openings 79 are engaged with each other, the protrusions 108 are respectively brought into contact with rear edge faces 79B defining rear ends of the respective openings 79. This contact restricts rearward movement of the ink tanks 100 with respect to the ink-tank holder 120.

When the ink tanks 100 are moved frontward with respect to the ink-tank holder 120 in the state in which the protrusions 109 and the respective openings 80 are engaged with each other, the protrusions 109 are respectively brought into contact with front edge faces 80A defining front ends of the respective openings 80. This contact restricts frontward movement of the ink tanks 100 with respect to the ink-tank holder 120. When the ink tanks 100 are moved rearward with respect to the ink-tank holder 120 in the state in which the protrusions 109 and the respective openings 80 are engaged with each other, the protrusions 109 are respectively brought into contact with rear edge faces 80B defining rear ends of the respective openings 80. This contact restricts rearward movement of the ink tanks 100 with respect to the ink-tank holder 120.

Thus, the protrusions 108 contact the end faces of the respective openings 79, and the protrusions 109 contact the end faces of the respective openings 80, whereby the ink tanks 100 are positioned in the front and rear direction 8. Each of the protrusions 108 and the protrusions 109 provided on the ink tanks 100, and each of the openings 79 and the openings 80 formed in the ink-tank holder 120 are one example of a positioner. While there are spaces between the protrusion 108 and each of the front edge face 79A and the rear edge face 79B of the opening 79 and between the protrusion 109 and each of the front edge face 80A and the rear edge face 80B of the opening 80 in FIG. 9, these spaces need not be formed.

As illustrated in FIG. 12, the standing wall 76 of the ink-tank holder 120 and the standing walls 102 of the ink tanks 100 are opposed to each other in the state in which the ink tanks 100 are positioned in the front and rear direction 8. Though not illustrated in FIG. 12, the inclined wall 77 of the ink-tank holder 120 and the inclined walls 106 of the ink tanks 100 are opposed to each other in this state. The length of a space between the standing wall 76 of the ink-tank holder 120 and a portion of each of the standing walls 102 of the respective ink tanks 100 to which the films 142, 143 are welded is a length G as one example of a particular length. The length of a space between the inclined wall 77 of the ink-tank holder 120 and a portion of each of the inclined walls 106 of the respective ink tanks 100 to which the films 142, 143 are welded is the length G as one example of the particular length. The length G is less than the protruding length (the length L) of each of the films 142, 143. Accordingly, the distal ends of the respective films 142, 143 are in contact with the standing wall 76 and the inclined wall 77 of the ink-tank holder 120 in the state in which the ink-tank holder 120 is positioned in the front and rear direction 8.

As a result, grooves 83A, 83B are formed in a front right end portion of each of the ink tanks 100Y, 100C, 100M. The grooves 83A, 83B are defined by the standing wall 76 and the inclined wall 77 of the ink-tank holder 120, the standing wall 102 and the inclined wall 106 of the ink tanks 100, and the film 142. Grooves 84A, 84B are formed in a front left end portion of the ink tank 100B. The grooves 84A, 84B are defined by the standing wall 76 and the inclined wall 77 of the ink-tank holder 120, the standing wall 102 and the inclined wall 106 of the ink tanks 100, and the film 143.

Each of the grooves 83A, 83B, 84A, 84B extends in a direction containing a component in the up and down direction 7. In the present embodiment, a portion of each of the grooves 83A, 83B, 84A, 84B which is defined by the inclined walls 77, 106 is inclined so as to extend in the down and front direction. A portion of each of the grooves 83A, 83B, 84A, 84B which is defined by the standing walls 76, 102 extends in the up and down direction 7.

Figure 10:
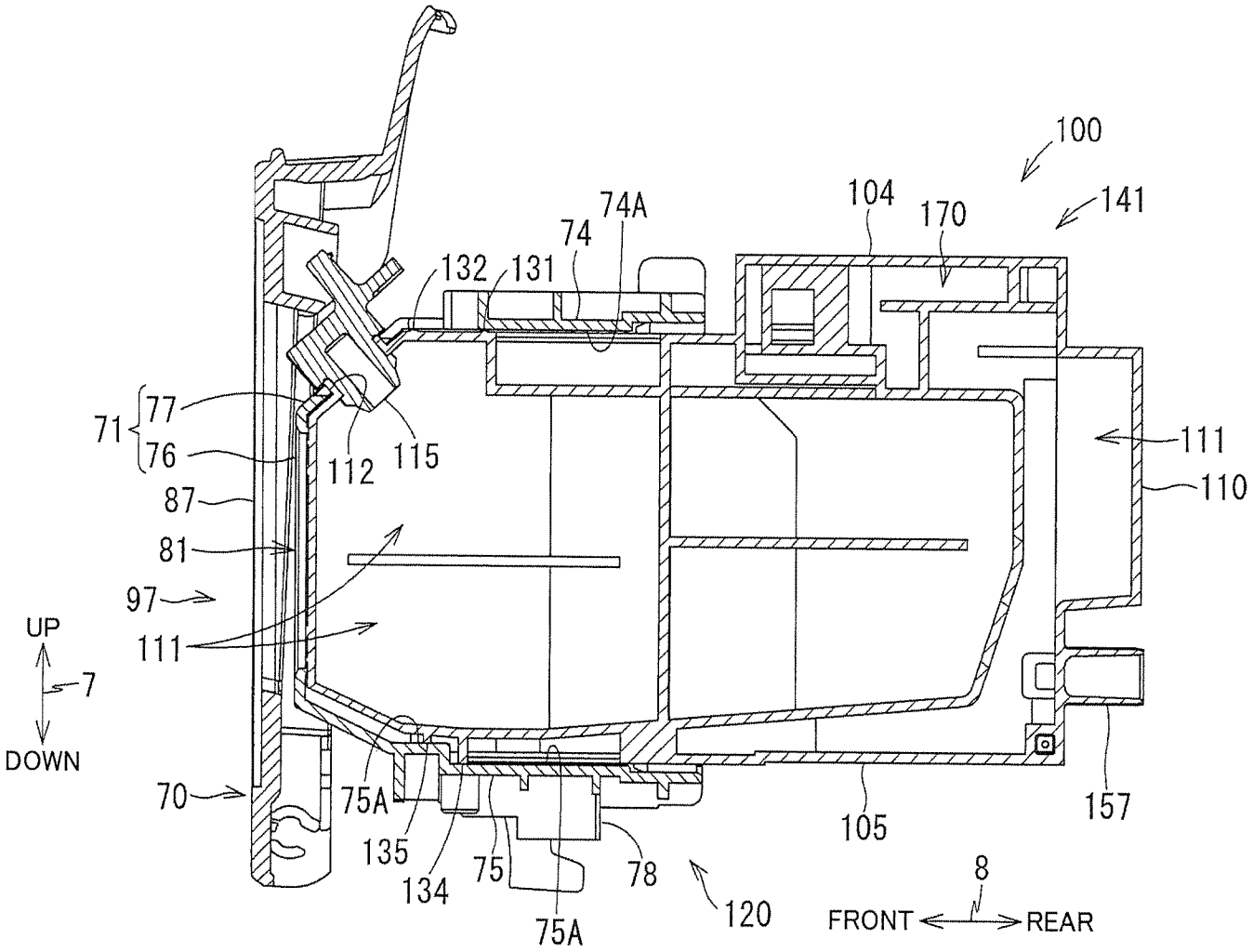
FIG. 10 is an elevational view in vertical cross section illustrating the ink tank, the ink-tank holder, and the cover.

In the state in which the protrusions 108 and the respective openings 79 are engaged with each other, and the protrusions 109 and the respective openings 80 are engaged with each other, as illustrated in FIG. 10, the protrusions 131, 132 are in contact with the surface 74A of the upper wall 74 near the inner space 127, the protrusions 134, 135 are in contact with the surface 75A of the lower wall 75 near the inner space 127. As a result, the ink tanks 100 are positioned in the up and down direction 7. It is noted that a space substantially corresponding to a tolerance may be formed between the surface 74A and each of the protrusions 131, 132.

In the state in which the protrusions 108 and the respective openings 79 are engaged with each other, and the protrusions 109 and the respective openings 80 are engaged with each other, as illustrated in FIG. 11A, the protrusions 130 are inserted in the respective openings 68. When the ink tanks 100 are moved rightward with respect to the ink-tank holder 120 in the state in which the protrusions 130 are inserted in the respective openings 68, the protrusions 130 are respectively brought into contact with right edge faces 68A defining right ends of the respective openings 68. When the ink tanks 100 are moved leftward with respect to the ink-tank holder 120 in the state in which the protrusions 130 are inserted in the respective openings 68, the protrusions 130 are respectively brought into contact with left edge faces 68B defining left ends of the respective openings 68.

In the state in which the protrusions 108 and the respective openings 79 are engaged with each other, and the protrusions 109 and the respective openings 80 are engaged with each other, as illustrated in FIG. 11B, the protrusions 133 are inserted in the respective openings 69. When the ink tanks 100 are moved rightward with respect to the ink-tank holder 120 in the state in which the protrusions 133 are inserted in the respective openings 69, the protrusions 133 are respectively brought into contact with right edge faces 69A defining right ends of the respective openings 69. When the ink tanks 100 are moved rightward with respect to the ink-tank holder 120 in the state in which the protrusions 133 are inserted in the respective openings 69, the protrusions 133 are respectively brought into contact with left edge faces 69B defining left ends of the respective openings 69.

Thus, the protrusions 130 are in contact with the end faces of the respective openings 68, the protrusions 133 are in contact with the end faces of the respective openings 69, whereby the ink tanks 100 are positioned in the right and left direction 9. While there are spaces between the protrusion 130 and each of the right edge face 68A and the left edge face 68B of the opening 68 and between the protrusion 133 and each of the right edge face 69A and the left edge face 69B of the opening 69 in FIGS. 11A and 11B, these spaces need not be formed.

In the state in which the ink tanks 100 are positioned in the right and left direction 9, as illustrated in FIGS. 11A and 11B, spaces 98 are formed such that each of the spaces 98 is located between corresponding adjacent two of the ink tanks 100.

As described above, as illustrated in FIGS. 7A and 7B, the ink-tank holder 120 holds the four ink tanks 100B, 100Y, 100C, 100M in the state in which the ink tanks 100B, 100Y, 100C, 100M are arranged in a row in the right and left direction 9. In the state in which the ink tanks 100B, 100Y, 100C, 100M are held by the ink-tank holder 120, the ink tanks 100B, 100Y, 100C, 100M are positioned by the ink-tank holder 120 in the up and down direction 7, the front and rear direction 8, and the right and left direction 9. It is noted that the ink tank 100B, the ink tank 100Y, the ink tank 100C, and the ink tank 100M are arranged in this order from the right side.

The ink-tank holder 120 covers the front portions of the respective ink tanks 100 in the state in which the ink tanks 100 are held by the ink-tank holder 120.

As illustrated in FIG. 8A, the standing wall 76 of the front wall 71 of the ink-tank holder 120 has a plurality of openings 81 each as one example of a light transmitting portion. The openings 81 are spaced apart from each other in the right and left direction 9. The openings 81 respectively correspond to the respective ink tanks 100B, 100Y, 100C, 100M. That is, four openings 81 are formed in the present embodiment. In the present embodiment, the shape of each of the openings 81 is a rectangular shape but may be any shape other than the rectangular shape.

In the state in which the ink tanks 100 are held by the ink-tank holder 120, as illustrated in FIG. 7A, a central portion (as one example of a particular portion and a liquid recognizable portion) of the standing wall 102 of the front wall 101 of each of the ink tanks 100 is exposable to the outside of the ink-tank holder 120 through a corresponding one of the openings 81. A peripheral portion of the standing wall 102 is covered with the standing wall 76 of the front wall 71 of the ink-tank holder 120. Hereinafter, the central portion of the standing wall 102 which is exposed to the outside of the ink-tank holder 120 through the opening 81 in the state in which the ink tanks 100 are held by the ink-tank holder 120 may be referred to as "particular portion of the standing wall 102".

In the state in which the ink tanks 100 are held by the ink-tank holder 120 and in the state in which the cover 70 is located at the closing position, as illustrated in FIG. 1A, the standing walls 102 of the ink tanks 100 are exposable to the outside of the printing device 11 via the respective openings 81 of the ink-tank holder 120 and the respective openings 97 of the cover 70. This configuration enables the user to check a remaining amount of ink stored in each of the ink tanks 100 from the outside.

As described above, the film 142 protrudes frontward from the right end of each of the ink tanks 100Y, 100C, 100M, and the film 143 protrudes frontward from the left end of the ink tank 100B. That is, the films 142, 143 protrude from the peripheral portion of the standing wall 102 of the front wall 101. That is, the films 142, 143 protrude from a portion of the standing wall 102 which is different from the particular portion.

As illustrated in FIGS. 8A and 8B, the inclined wall 77 of the front wall 71 of the ink-tank holder 120 has openings 82. The openings 82 are spaced apart from each other in the right and left direction 9. The openings 82 correspond to the respective ink tanks 100B, 100Y, 100C, 100M. That is, four openings 82 are formed in the present embodiment. In the present embodiment, the shape of each of the openings 82 is a round shape but may be any shape other than the round shape.

In the state in which the ink tanks 100 are held by the ink-tank holder 120, as illustrated in FIG. 7A, the supply opening 112 of each of the ink tanks 100 is exposable to the outside of the ink-tank holder 120 through a corresponding one of the openings 82.

As illustrated in FIGS. 8A and 8B, a front portion of the upper wall 74 of the ink-tank holder 120 is formed with a cap mount portion 155 on which a cap 113 which will be described below is mountable.

Cap 113

As illustrated in FIGS. 7A and 7B, the ink tanks 100 respectively include caps 113B, 113Y, 113C, 113M, which may be hereinafter collectively referred to as "caps 113". The caps 113B, 113Y, 113C, 113M respectively correspond to the supply openings 112B, 112Y, 112C, 112M of the respective ink tanks 100.

Each of the caps 113 is formed of an elastically-deformable material such as rubber and elastomer. The cap 113 includes a cap portion 115, an elastically-deformable portion 116, and a fitting portion 117. It is noted that the construction of the cap 113 is not limited to a construction described below.

The cap portion 115 has a generally disc shape as an outer shape.

The elastically-deformable portion 116 has a strip shape. One end of the elastically-deformable portion 116 is connected to the cap portion 115. The other end of the elastically-deformable portion 116 is connected to the fitting portion 117. In a state in which no external force is applied to the elastically-deformable portion 116, as illustrated in FIGS. 7A and 7B, the elastically-deformable portion 116 substantially extends straight.

The fitting portion 117 is fittable on the cap mount portion 155. With this construction, the caps 113 are mounted on the ink-tank holder 120.

Each of the cap portions 115 is brought into close contact with a wall surface defining an circumferential edge of a corresponding one of the supply openings 112, whereby the cap 113 fluid-tightly seals the supply opening 112. Though not illustrated, the elastically-deformable portion 116 is bent in an arc-shape in this state.

As illustrated in FIGS. 7A and 7B, when the cap portion 115 is moved off the supply opening 112, the supply opening 112 is opened, enabling supply of the ink to the ink chamber 111 through the supply opening 112. When the cap 113 is located at the spaced position, the elastically-deformable portion 116 is unbent and extends substantially straight.

Rib 148

As illustrated in FIGS. 4A and 5A, a rib 148 protruding from the front surface 106A is formed on the inclined wall 106 of the front wall 101. It is noted that drawings other than FIGS. 4A and 5A omit illustration of the rib 148.

The rib 148 is formed below the supply opening 112 and above the particular portion of the standing wall 102. That is, the rib 148 is formed between the supply opening 112 and the particular portion of the standing wall 102 in the up and down direction 7.

The rib 148 extends in a direction having a component in the right and left direction 9. In the present embodiment, the rib 148 is inclined so as to be lower at its right portion than at its center in the right and left direction 9 and inclined so as to be lower at its left portion than at its center in the right and left direction 9. That is, the rib 148 is inclined with respect to the right and left direction 9 so as to be lower at its portion near the film 142 protruding frontward from a right end of the standing wall 102 of the ink tank 100Co than at its portion far from the film 142. The rib 148 is inclined with respect to the right and left direction 9 so as to be lower at its portion near the film 143 protruding frontward from a left end of the standing wall 102 of the ink tank 100B than at its portion far from the film 143.

The rib 148 extends from a position located to the left of the particular portion of the standing wall 102, to a position located to the right of the particular portion of the standing wall 102. In other words, the particular portion of the standing wall 102 is located between the left end and the right end of the rib 148 in the right and left direction 9.

It is noted that the shape of the rib 148 is not limited to the shape of the rib 148 illustrated in FIG. 4A. For example, the rib 148 may be shorter in the right and left direction 9 than that illustrated in FIG. 4A. Even in this case, the rib 148 preferably extends from a position located to the left of the particular portion of the standing wall 102, to a position located to the right of the particular portion of the standing wall 102.

The rib 148 may extend straight in the right and left direction 9, may be inclined so as to be lower at its right end than at its left end, and may be inclined so as to be lower at its left end than at its right end.

The rib 148 may be formed at a position different from a position of the rib 148 illustrated in FIG. 4A. For example, the rib 148 may be formed not on the front surface 106A of the inclined wall 106 but on the front surface 102A of the standing wall 102 and may be formed so as to extend over the front surface 106A of the inclined wall 106 and the front surface 102A of the front wall 101.

Flow of Ink Having Leaked to Outside During Ink Supply

When the ink is to be supplied to the ink chamber 111 of the ink tank 100, a distal end of a container, such as a bottle, containing the ink is inserted into the supply opening 112 of the ink tank 100. The ink may leak to the outside of the ink tank 100 and adhere to a portion of the front surface 106A of the inclined wall 106 near the supply opening 112 in insertion of the container into the supply opening 112, in removal of the container from the supply opening 112, or in supply of the ink from the container to the ink tank 100.

The ink having adhered to the front surface 106A flows obliquely frontward and downward along the inclined wall 106 and reaches the rib 148 (see FIGS. 4A and 5A). The ink having reached the rib 148 flows along the rib 148 and reaches a right end portion or a left end portion of the inclined wall 106.

In each of the ink tanks 100Y, 100C, 100M, the ink having reached the right end portion of the inclined wall 106 flows downward along the groove 83A (see FIG. 12) due to a capillary phenomenon. In each of the ink tanks 100Y, 100C, the ink having reached the left end portion of the inclined wall 106 flows downward due to the capillary phenomenon along the groove 83B of the ink tank 100 (see FIG. 12) located next to and to the left of each of the ink tanks 100Y, 100C. In the ink tank 100B, the ink having reached the left end portion of the inclined wall 106 flows downward along the groove 84A due to the capillary phenomenon.

Effects

In the above-described embodiment, since the length L is greater than the length G, the films 142, 143 are in contact with the ink-tank holder 120 in the state in which the ink tanks 100 are covered with the ink-tank holder 120. As a result, the grooves 83A, 83B, 84A, 84B defined by the standing wall 102, the ink-tank holder 120, and the films 142, 143 are formed. With this configuration, if the ink has erroneously leaked to the outside of the ink tank 100 when the ink tank 100 is refilled with the ink through the supply opening 112, most of the leaked ink flows along the grooves 83A, 83B, 84A, 84B due to the capillary phenomenon. This construction reduces a possibility that the leaked ink flows and adheres to the central portion of the standing wall 102 which is exposed to the outside of the standing wall 102.

In the above-described embodiment, the ink tanks 100 are positioned with respect to the ink-tank holder 120 by the positioner (i.e., the protrusions 108 and the protrusions 109 provided on the ink tanks 100 and the openings 79 and the openings 80 formed in the ink-tank holder 120) in the state in which the ink tanks 100 are covered with the ink-tank holder 120. In this state, the distance, in the direction in which each of the films 142, 143 protrudes, between the ink-tank holder 120 and each of the portions of the films 142, 143 which are bonded to the ink tanks 100 is equal to the length G. In the above-described embodiment, the length of a portion of each of the films 142, 143 which protrudes from the standing wall 102 (i.e., the protruding length) is equal to the length L slightly greater than the length G, whereby the grooves 83A, 83B, 84A, 84B can be formed reliably. Since the protruding length (the length L) is slightly greater than the length G, the depth, the width, and so on of each of the grooves 83A, 83B, 84A, 84B may be set to such values that the ink easily flows due to the capillary phenomenon.

In the above-described embodiment, if the ink has erroneously leaked to the outside of the ink tank 100 when the ink tank 100 is refilled with the ink through the supply opening 112, the ink having flowed toward the right end of the standing wall 102 can be guided to the grooves 83A, 84B. Also, the ink having flowed toward the left end of the standing wall 102 can be guided to the grooves 83B, 84A. This configuration reduces adherence of the leaked ink to the central portion of the standing wall 102 which is exposed to the outside of the standing wall 102.

The films 142, 143 are provided on at least one of the right surface and the left surface of the ink tank 100, resulting in reduced length of the ink tank 100 in the right and left direction 9.

In the above-described embodiment, each of the angles θ1, θ2 (see FIG. 12) is an acute angle for the grooves 83A, 83B, 84A, 84B. With this configuration, the ink having flowed into the grooves 83A, 83B, 84A, 84B easily flows due to the capillary phenomenon.

In the above-described embodiment, if the ink has erroneously leaked to the outside of the ink tank 100 when the ink tank 100 is refilled with the ink through the supply opening 112, the rib 148 prevents the leaked ink from flowing to the central portion of the standing wall 102 which is exposed to the outside of the standing wall 102. This configuration reduces adherence of the leaked ink to the central portion of the standing wall 102 which is exposed to the outside of the standing wall 102.

When the ink having leaked to the outside of the ink tank 100 has flowed along the rib 148, reached the right end or the left end of the rib 148, and moved off the rib 148, the ink flows downward. In the above-described embodiment, the central portion of the standing wall 102 which is exposed to the outside of the standing wall 102 is located between the right end and the left end of the rib 148. This configuration reduces adherence of the ink having flowed downward, to the central portion of the standing wall 102 which is exposed to the outside of the standing wall 102.

In the above-described embodiment, the rib 148 is inclined with respect to the right and left direction 9 so as to be lower at its portion near the films 142, 143 than at its portion far from the films 142, 143 in the right and left direction 9. With this configuration, the ink having leaked to the outside of the ink tank 100 can be guided to the grooves 83A, 83B, 84A, 84B along the inclined rib 148.

In the above-described embodiment, the ink-tank holder 120 holds the ink tanks 100 in the state in which the ink tanks 100 are arranged in the right and left direction 9. Thus, if the ink has erroneously leaked to the outside of the ink tank 100 when the ink tank 100 is refilled with the ink through the supply opening 112, the films 142, 143 can prevent the leaked ink from adhering to the standing wall 102 of the ink tank 100 located next to the ink tank 100 refilled with the ink.

Modifications

The wall having the supply opening 112 (the inclined wall 106) and the standing wall 102 are continuous to each other in the above-described embodiment but may be continuous to each other. For example, another wall may be disposed between the standing wall 102 and the wall having the supply opening 112.

In the above-described embodiment, as illustrated in FIG. 12, the film 142 protrudes obliquely frontward and leftward from the front wall 101 (the standing wall 102 and the inclined wall 106), and the film 143 protrudes obliquely frontward and rightward from the front wall 101. However, the protruding directions of the films 142, 143 are not limited to these directions. For example, the films 142, 143 may extend straight in the front direction. That is, each of the angles θ1, θ2 (see FIG. 12) is an acute angle in the above-described embodiment but may be any of a right angle and an obtuse angle. For example, in the case where each of the films 142, 143 protrudes straight in the front direction from the front wall 101 of the ink tank 100, each of the angles θ1, θ2 is a right angle.

The protruding length of each of the films 142, 143 from the front wall 101 is constant in the above-described embodiment but may not be constant. For example, the protruding length of a portion of each of the films 142, 143 which protrudes from an upper portion of the standing wall 102 may be greater than the protruding length of a portion of each of the films 142, 143 which protrudes from a lower portion of the standing wall 102.

The direction in which the portion of each of the films 142, 143 which protrudes from the front wall 101 extends is not limited to the above-described direction as long as the direction in which the portion of each of the films 142, 143 extends contains a component in the up and down direction 7. For example, the portion of each of the films 142, 143 which protrudes from the front wall 101 may extend in the down and right direction.

In the above-described embodiment, the film 142 protrudes only from the front right end of each of the ink tanks 100Y, 100C, 100M, and the film 143 protrudes only from the front left end of the ink tank 100B. However, the film 143 may protrude only from the front left end of each of the ink tanks 100Y, 100C, 100M, and the film 142 may protrude only from the front right end of the ink tank 100B. The films 142, 143 may protrude from both of the front right end and the front left end of the ink tank 100.

The position from which each of the films 142, 143 protrudes may be a position other than the front left end and the front right end of the standing wall 102 as long as the position is different from the particular portion of the standing wall 102. For example, the position from which each of the films 142, 143 protrudes may be a position between the particular portion of the standing wall 102 and the left end of the standing wall 102 in the right and left direction 9 and may be a position between the particular portion of the standing wall 102 and the right end of the standing wall 102.

In the above-described embodiment, the films 142, 143 define the grooves 83A, 83B, 84A, 84B and define right and left surfaces of the ink chamber 111. However, films defining the grooves 83A, 83B, 84A, 84B and a film defining the right surface and the left surface of the ink chamber 111 may be different from each other.

For example, in the ink tank 100 illustrated in FIG. 4B, the film 143 for defining the left surface of the ink chamber 111 may be welded to a portion of the ink tank 100 which is located at a rear of the left wall 103, and a film protruding frontward from the left wall 103 may be welded to a front end portion of the left wall 103. In this case, the film welded to the front end portion of the left wall 103 defines the grooves 84A, 84B.

In the above-described embodiment, the films 142, 143 are bonded to the frame 141 by welding but may be bonded to the frame 141 by any method other than welding. For example, the films 142, 143 are bonded to the frame 141 by adhesive.

In the above-described embodiment, the films 142, 143 protrude frontward from the front wall 101. However, the direction in which each of the films 142, 143 protrudes from the ink tank 100 is not limited to the front direction. For example, each of the films 142, 143 may protrude upward from the upper wall 104, may protrude rearward from the rear wall 110, and may protrude downward from the lower wall 105.

In the above-described embodiment, as illustrated in FIGS. 7A and 7B, the ink-tank holder 120 covers the front portions of the respective ink tanks 100 which include the standing walls 102, in the state in which the ink tanks 100 are held by the ink-tank holder 120. However, the ink-tank holder 120 may cover the ink tanks 100 in a manner different from that illustrated in FIGS. 7A and 7B as long as the ink-tank holder 120 covers the standing walls 102. For example, the ink-tank holder 120 may cover only the standing walls 102 of the respective ink tanks 100 and may cover all the ink tanks 100.

In the above-described embodiment, the ink-tank holder 120 has the openings 81. Also, the central portion of the standing wall 102 of the front wall 101 of each of the ink tanks 100 is exposed to the outside of the ink-tank holder 120 through the corresponding opening 81. With this configuration, the central portion of the standing wall 102 of the front wall 101 of each of the ink tanks 100 can be visually recognized from the outside of the ink-tank holder 120 through the corresponding opening 81. However, the elements of the ink-tank holder 120 which enable the user to visually recognize the central portion of the standing wall 102 of the front wall 101 of each of the ink tanks 100 are not limited to the openings 81. For example, the central portion of the standing wall 76 of the front wall 71 of the ink-tank holder 120 may be formed of a material having light transparency such as glass. With this configuration, the central portion of the standing wall 102 of the front wall 101 of each of the ink tanks 100 can be visually recognized from the outside of the ink-tank holder 120 through the corresponding standing wall 76. In this case, the central portion of the standing wall 76 of the front wall 71 of the ink-tank holder 120 is one example of the light transmitting portion.

The configuration in which the ink-tank holder 120 positions the ink tanks 100 is not limited to the configuration in the above-described embodiment, and a well-known configuration for positioning may be employed.

In the above-described embodiment, the MFP 10 includes the four ink tanks 100. However, the number of the ink tanks 100 is not limited to four and may be less than or equal to three and may be greater than or equal to five.

In the above-described embodiment, the ink tanks 100 are disposed in a space extending rearward from the front wall 14A of the housing 14. However, the positions of the ink tanks 100 are not limited to these positions. For example, the ink tanks 100 may be disposed in a space extending leftward from a right wall of the housing 14. In this case, the particular portion of the standing wall 102 is visually recognized from a right side of the MFP 10.

While the ink is one example of the liquid in the above-described embodiment, the present disclosure is not limited to this configuration. That is, the following liquid may be used instead of the ink: pretreatment liquid which is ejected onto a recording sheet in advance of the ink during printing; and water which is sprayed onto the recording head 39 at positions near the nozzles 40 to prevent drying of the nozzles 40 of the recording head 39, for example.

Alternative Embodiment

There will be next described an alternative embodiment of the MFP. A liquid supply apparatus according to the alternative embodiment includes tanks, a cover, and films.

Each of the tanks includes: a liquid storage chamber; a first wall that extends in its widthwise direction directed along the horizontal direction and that is configured such that the liquid stored in the liquid storage chamber is visually recognizable from the outside of the tank; and a second wall having a supply opening for supplying the liquid to the liquid storage chamber.

The cover includes a third wall having a light transmitting portion. The cover is capable of covering at least the first wall among portions of the tank in a state in which the third wall and the first wall are opposed to each other, and a particular portion of the first wall is exposed to the outside through an opening.

Each of the films is bonded to a corresponding one of the tanks in a state in which the film protrudes toward the third wall from a portion of the first wall which is different from the particular portion. The film extends in a direction containing a component in the up and down direction.

An outer surface of the second wall has a recessed portion and a groove extending from the recessed portion to a portion of the first wall at which the film protrudes. The supply opening is formed in the recessed portion.

Figure 14:
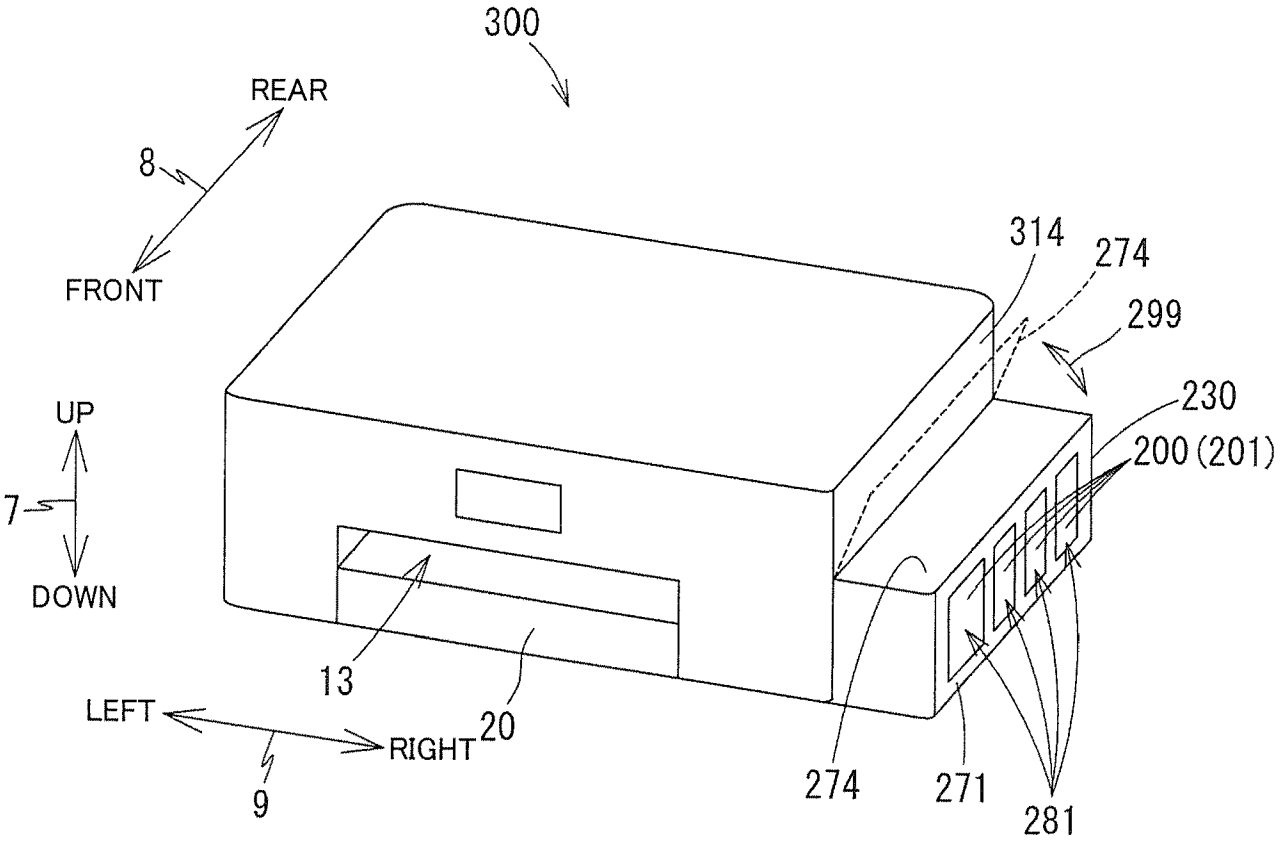
FIG. 14 is an external perspective view of an MFP according to an alternative embodiment.
Figure 15:
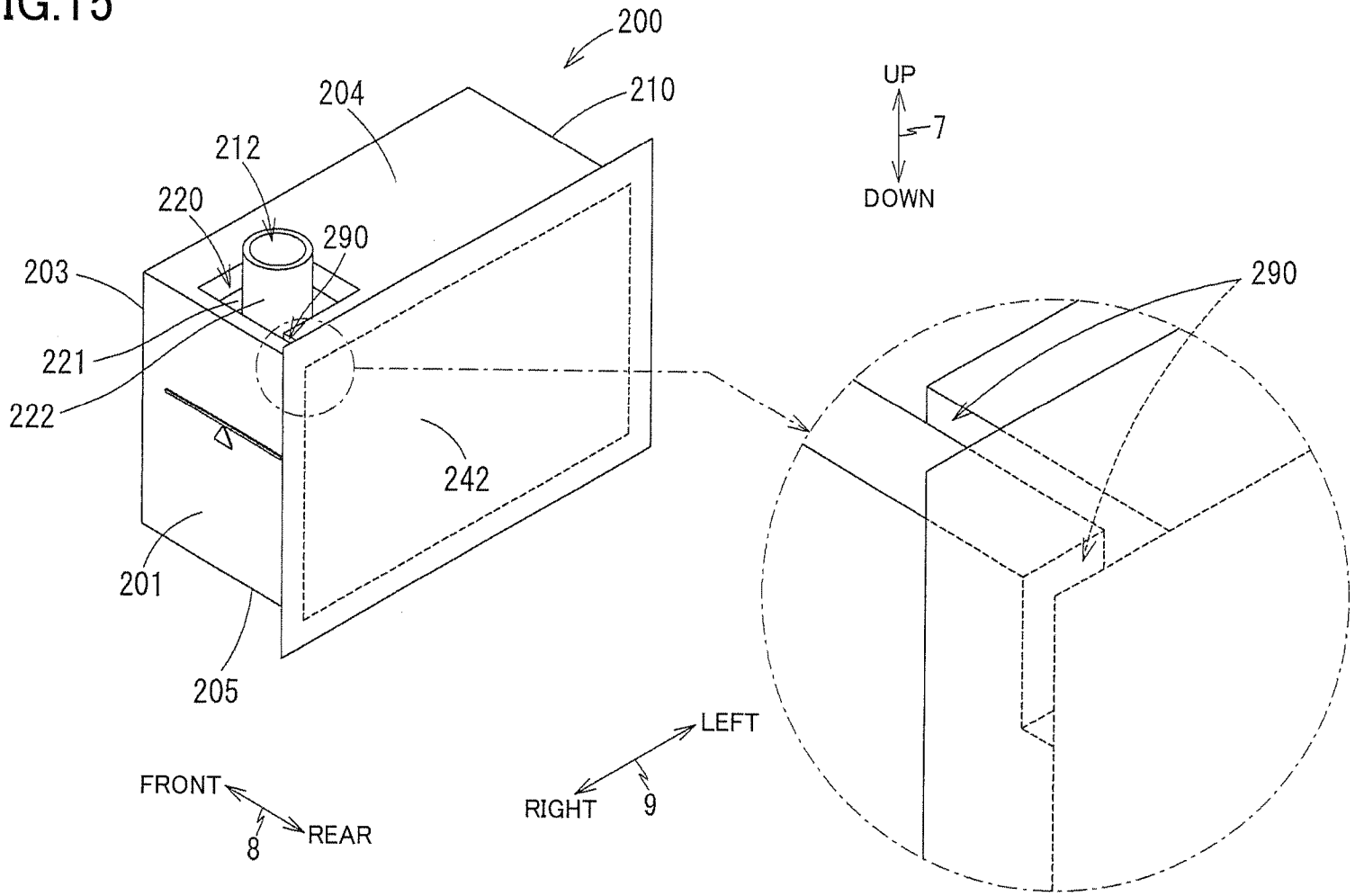
FIG. 15 is a perspective view of an ink tank in the alternative embodiment.

This alternative embodiment will be described in detail. FIG. 14 illustrates an MFP 300 according to the alternative embodiment (as one example of a liquid consuming device). As illustrated in FIG. 15, the MFP 300 includes four ink tanks 200 (each as another example of the tank). It is noted that the number of the ink tanks 200 is not limited to four.

As illustrated in FIG. 15, each of the ink tanks 200 is shaped like a box including a front wall 201, an upper wall 204, a lower wall 205, and a rear wall 210. A portion of at least one of right and left surfaces of the ink tank 200 is constituted by a film 242. In FIG. 15, the right surface of the ink tank 200 is constituted by the film 242, and the left surface of the ink tank 200 is constituted by a left wall 203. The film 242 is welded to right surfaces of the front wall 201 (as another example of the first wall), the upper wall 204 (as another example of the second wall), the lower wall 205, and the rear wall 210. The ink tank 200 has an ink chamber (as another example of the liquid storage chamber) configured to store the ink (as one example of the liquid) therein.

At least the front wall 201 among the portions of the ink tank 200 is formed of resin having such light transparency that the ink in the ink tank 200 is visually recognizable from the outside of the ink tank 200.

An upper surface of the upper wall 204 (as another example of the outer surface) has a recessed portion 220 recessed downward. A supply opening 212 is formed in a bottom surface 221 of the recessed portion 220. In FIG. 15, the supply opening 212 is formed in a cylindrical member 222 extending upward from the bottom surface 221. It is noted that the ink tank 200 may not include the cylindrical member 222. For example, the supply opening 212 may be replaced with a hole formed in the bottom surface 221. The supply opening 212 establishes communication between the ink chamber and the outside of the ink tank 200. The ink is supplied from the outside to the ink chamber via the supply opening 212.

The upper surface of the upper wall 204 has a groove 290 extending from the recessed portion 220 to a portion of the front wall 201 at which the film 242 protrudes (to a right end of the front wall 201 in FIG. 15).

It is noted that, in the case where the film protrudes from a left end of the front wall 201, the groove 290 may be formed so as to connect between the recessed portion 220 and the left end of the front wall 201. The MFP 300 may have (i) a groove connecting between the recessed portion 220 and the right end of the front wall 201 and (ii) a groove connecting between the recessed portion 220 and the left end of the front wall 201. The groove 290 may have any depth. For example, the depth of the groove 290 may be equal to or less than that of the recessed portion 220.

Like the films 142, 143 in the above-described embodiment, the film 242 protrudes frontward from an edge portion of the front wall 201 (from the right end of the front wall 201 in FIG. 15). The relationship between the protruding length of the film 142 in the front and rear direction 8 and the length G of the space between the standing wall 76 and the portion of the standing wall 102 to which the film 142 is welded is defined as in FIG. 12. However, the protruding length and the length of the space may be defined as follows. In FIG. 12, in the case where a position nearest to the standing wall 76 in a portion of the film 142 which is bonded to the standing wall 102 is defined as a nearest bonded position, the nearest bonded position is located at a front end of the portion of the standing wall 102 to which the film 142 is bonded. In the case, when the distance between the nearest bonded position and a position of the distal end of the protruding portion of the film 142 in the state in which the ink tanks 100 are not held in the ink-tank holder 120 is greater than the distance between the nearest bonded position and the standing wall 76 in the state in which the ink tanks 100 are held by the ink-tank holder 120, the distal end of the protruding portion of the film 142 can be in contact with the standing wall 76 in the state in which the ink tanks 100 are held by the ink-tank holder 120. Thus, in the case where the length of the portion of the film 142 which protrudes from the standing wall 102 in the front and rear direction 8 (i.e., the distance between the nearest bonded position and the distal end of the protruding portion of the film 142) in the state in which the ink tanks 100 are not held by the ink-tank holder 120 is defined as the protruding length, and the distance between the standing wall 76 and the portion of the film 142 which is bonded to the ink tank 100 (i.e., the distance between the nearest bonded position and the standing wall 76) in the state in which the ink tanks 100 are held by the ink-tank holder 120 is defined as a particular length, the film 142 is bonded to the ink tank 100 such that the protruding length is greater than the particular length. With this configuration, the distal end of the protruding portion of the film 142 can be reliably in contact with the standing wall 76 in the state in which the ink tanks 100 are held by the ink-tank holder 120.

As illustrated in FIG. 14, the MFP 300 includes a cover 230 capable of covering at least the front wall 201 among the portions of the ink tank 200. The cover 230 covers the ink tanks 200 in a state in which the ink tanks 200 are arranged in a row. It is noted that the cover 230 is provided at a right end portion of a housing 314 of the MFP 300 in FIG. 14 but may be provided at another portion of the housing 314 such as a front end portion and a left end portion of the housing 314.

A front wall 271 (as another example of the third wall) of the cover 230 has openings 281 through which the particular portions of the front walls 201 of the respective ink tanks 200 (portions of the front walls 201 of the respective ink tanks 200 other than their respective edge portions in FIG. 14) are exposable. An upper wall 274 of the cover 230 pivots in a direction indicated by an arrow 299 and is thereby movable between an open position (indicated by the broken lines in FIG. 14) and a closed position (indicated by the solid lines in FIG. 14). When the upper wall 274 is located at the open position, the supply openings 212 of the respective ink tanks 200 (see FIG. 15) are exposed to the outside. This enables supply of the ink to the ink chambers via the supply openings 212.

The cover 230 is supported by the housing 314. The ink tanks 200 are also supported by the housing 314. In the state in which the cover 230 and the ink tanks 200 are supported by the housing 314, the particular portions of the front walls 201 of the respective ink tanks 200 are exposed to the outside through the respective openings 281. In this state, the front wall 271 of the cover 230 and the front walls 201 of the respective ink tanks 200 are opposed to each other. Also, the films 242 protruding from the front walls 201 of the respective ink tanks 200 are in contact with the front wall 271 of the cover 230 in this state. As a result, the front wall 201 of the ink tank 200, the film 242, and the front wall 271 of the cover 230 define a groove extending in the up and down direction 7.

It is noted that the ink tanks 200 may be supported by the cover 230 as in the above-described embodiment.

It is noted that the configurations of the modifications of the above-described embodiment may be employed to the alternative embodiment.

What is claimed is:

1. A liquid supply apparatus, comprising:

a tank comprising (i) a liquid storage chamber, (ii) a first wall that extends in a widthwise direction directed along a horizontal direction and that is configured such that liquid stored in the liquid storage chamber is visually recognizable from an outside of the tank, and (iii) a second wall provided above the first wall and comprising a supply opening through which the liquid is to be supplied to the liquid storage chamber;

a cover comprising a third wall comprising a light transmitting portion, the cover being configured to cover at least the first wall of the tank in a state in which the third wall and the first wall are opposed to each other, and a particular portion of the first wall is visually recognizable from an outside of the cover via the light transmitting portion;

a film bonded to the tank such that a portion of the film protrudes toward the cover from a portion of the first wall which is different from the particular portion; and a positioner configured to position the tank with respect to the cover in a state in which a distance, in a direction in which the film protrudes, between the cover and a portion of the film which is bonded to the tank is equal to a particular length, wherein the film extends in a direction containing a component in an up and down direction, and wherein a length of the portion of the film which protrudes from the first wall is greater than the particular length.

2. The liquid supply apparatus according to claim 1, wherein the tank comprises a first side surface defining the liquid storage chamber and extending, in a direction directed along the horizontal direction and intersecting the widthwise direction, from one of opposite ends of the first wall in the widthwise direction, and wherein the first side surface comprises a portion constituted by the film.

3. The liquid supply apparatus according to claim 2, wherein the tank comprises a second side surface defining the liquid storage chamber and extending, in the direction directed along the horizontal direction and intersecting the widthwise direction, from another of the opposite ends of the first wall in the widthwise direction, and wherein the second side surface comprises a portion constituted by the film.

4. The liquid supply apparatus according to claim 1, wherein an angle between an outer surface of the first wall and one of opposite surfaces of the portion of the film which protrudes from the first wall is an acute angle, and the one is nearer to the first wall than another of the opposite surfaces.

5. The liquid supply apparatus according to claim 4, wherein the particular portion of the first wall is located between one end and another end of the rib in the widthwise direction.

6. The liquid supply apparatus according to claim 5, wherein a rib extending in a direction containing a component of the widthwise direction is formed on an outer surface of at least one of the first wall and the second wall at a position located between the particular portion of the first wall and the supply opening.

7. The liquid supply apparatus according to claim 6, wherein the rib is inclined with respect to the widthwise direction so as to be lower at one of opposite end portions of the rib in the widthwise direction than another of the opposite end portions of the rib, and the one of opposite end portions of the rib is nearer to the film than the other of the opposite end portions.

8. The liquid supply apparatus according to claim 1, wherein the cover is configured to hold a plurality of tanks such that the plurality of tanks are arranged in the widthwise direction, each of the plurality of tanks comprising, the same as the tank, a liquid storage chamber, a first wall, and a second wall.

9. A liquid supply apparatus, comprising:

a tank comprising (i) a liquid storage chamber, (ii) a first wall that extends in a widthwise direction directed along a horizontal direction and that is configured such that liquid stored in the liquid storage chamber is visually recognizable from an outside of the tank, (iii) a second wall provided above the first wall and comprising a supply opening through which the liquid is to be supplied to the liquid storage chamber, and (iv) a side wall extending in a direction orthogonal to the widthwise direction;

a cover comprising a third wall comprising a light transmitting portion, the cover being configured to cover at least the first wall of the tank in a state in which the third wall and the first wall are opposed to each other, and a liquid recognizable portion of the first wall is visually recognizable from an outside of the cover via the light transmitting portion; and a film bonded to the tank such that a portion of the film contacts the cover by protruding from an end of a portion of the side wall.

10. The liquid supply apparatus according to claim 9, further comprising a positioner configured to position the tank with respect to the cover in a state in which a distance, in a direction in which the film protrudes, between the cover and a portion of the film which is bonded to the tank is equal to a particular length, wherein the film extends in a direction containing a component in an up and down direction, and wherein a length of the portion of the film which protrudes from the end of the portion of the side wall is greater than the particular length.

11. The liquid supply apparatus according to claim 9, wherein the portion of the side wall, from which the portion of the film protrudes, is located at least between the supply opening and the liquid recognizable portion.

12. The liquid supply apparatus according to claim 9, wherein the film is bonded to the tank such that a portion of the film contacts the cover by protruding from an end of a portion of the side wall, the end continuing to the second wall.

* * * * *